US006511156B1

(12) United States Patent
Kazama et al.

(10) Patent No.: US 6,511,156 B1
(45) Date of Patent: Jan. 28, 2003

(54) INK-JET HEAD NOZZLE PLATE, ITS MANUFACTURING METHOD AND INK-JET HEAD

(75) Inventors: Ayako Kazama, Tokorozawa (JP); Nobuyuki Yoshino, Tokorozawa (JP); Yorinobu Yamada, Tokorozawa (JP); Isao Mizuma, Nagano (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/446,070

(22) PCT Filed: May 13, 1998

(86) PCT No.: PCT/JP98/02111

§ 371 (c)(1),
(2), (4) Date: Dec. 17, 1999

(87) PCT Pub. No.: WO99/15337

PCT Pub. Date: Apr. 1, 1999

(30) Foreign Application Priority Data

| | | |
|---|---|---|
| Sep. 22, 1997 | (JP) | 9-256501 |
| Oct. 23, 1997 | (JP) | 9-308101 |
| Oct. 23, 1997 | (JP) | 9-308102 |
| Dec. 9, 1997 | (JP) | 9-354000 |
| Dec. 9, 1997 | (JP) | 9-354001 |
| Jan. 23, 1998 | (JP) | 10-025222 |
| Jan. 29, 1998 | (JP) | 10-030369 |

(51) Int. Cl.[7] ..... B41J 2/14
(52) U.S. Cl. ..... 347/47
(58) Field of Search ..... 430/270.1, 271.1, 430/269, 31; 347/47, 45

(56) References Cited

U.S. PATENT DOCUMENTS

| | | | | |
|---|---|---|---|---|
| 5,387,440 A | * | 2/1995 | Takemoto et al. | 205/127 |
| 5,759,421 A | * | 6/1998 | Takemoto et al. | 216/27 |
| 5,919,600 A | * | 7/1999 | Huang et al. | 430/272.1 |

FOREIGN PATENT DOCUMENTS

| | | |
|---|---|---|
| JP | 8-230195 | 9/1996 |
| JP | 9-109400 | 4/1997 |

* cited by examiner

*Primary Examiner*—John S. Hilten
*Assistant Examiner*—K. Feggins
(74) *Attorney, Agent, or Firm*—Finnegan, Henderson, Farabow, Garrett & Dunner, L.L.P.

(57) ABSTRACT

A nozzle plate for an ink-jet head used in an ink-jet type recorder, comprising a flat plate member which defines an ink blow-out surface on one main surface thereof and has a plurality of ink blow-out nozzles penetrating at predetermined positions, wherein said ink blow-out surface and portions on the inner surfaces of said ink blow-out nozzles neighboring said ink blow-out surface, have, at least partly, an ink-repelling layer of a fluorine-contained resin-containing electrolytic or non-electrolytic composite plating. Upon forming a particular ink-repelling layer on the nozzle plate, it is possible to prevent the ink from staying adhered on the peripheries of the nozzles after the ink droplets are blown out from the nozzles, permitting the ink droplets to fly stably toward the recording medium.

18 Claims, 20 Drawing Sheets

(A)

(B)

(C)

INK-JET HEAD NOZZLE PLATE, ITS MANUFACTURING METHOD AND INK-JET HEAD

TECHNICAL FIELD

The present invention relates to a recording device of the ink-jet type and, particularly, to a nozzle plate for an ink-jet head used for an ink-jet printer, to a method of producing the same and to an ink-jet head using the same. In the ink-jet head of the present invention, a particular ink-repelling layer is formed on the ink blow-out surface of the nozzle plate. Therefore, no ink remains at the ends of the nozzles even after repetitive use, and the ink droplets are permitted to stably fly straight to maintain high printing quality over extended periods of time.

BACKGROUND ART

As is well known, an ink-jet printer records characters, figures, patterns and the like on the surface of paper, a film or any other medium by injecting an ink (aqueous ink or nonaqueous ink) through fine nozzles attached to the ends of an ink-jet head, so that the ink droplets fly toward the surface thereof. An aqueous ink is usually used. There can be employed various recording methods depending on the method of forming ink droplets, the method of producing injection energy, etc. For example, the electric charge-controlled recording method uses a piezoelectric element; i.e., a pressure wave is produced in the ink chamber of the head in which the ink is filled by utilizing vibration of the element, thereby to eject the ink by the pressure wave. There have further been known such methods as an electromechanical conversion method, an electro-thermal conversion method, an electrostatic suction method and a discharge method. The ink-jet printer has many merits as indicated by, for example, the facts that (1) printing is accomplished in a non-contacting manner, (2) printing can be effected onto a variety kinds of media, (3) a plain paper can be used to lower the running cost, (4) color printing can be easily accomplished, (5) colors can be vividly reproduced, (6) less noise is produced during the printing, (7) printing can be executed at high speed, etc.

In the ink-jet printer, as will be described later in detail, fine nozzles (usually called "nozzles for blowing out ink" or "ink blow-out nozzles") for blowing out the ink have a structure of being formed in a plural number in a nozzle plate, and may be arranged in a single row or in a plurality of rows. The nozzle plate is usually made of a metal material such as a stainless steel or nickel, or a plastic material or ceramic material, and has a thickness of about 0.1 mm, the diameter of the nozzles for blowing out the ink being, generally, from about 30 to about 60 $\mu$m.

In order for the ink droplets to be stably blown out straight, in general, the ink must not stay adhered on the nozzle plate near the ink blow-out nozzles and, besides, stability must be improved, in these portions, for the ink. This is because the adhesion of the ink (so-called "ink droplet pool") near the ends of the nozzles, grows as the ink oozes out, or the residue of the ink droplets that have flown builds up. Adhesion of the residual ink disturbs the direction in which the ink droplets fly and causes a change in the flying speed, too.

In order to accomplish this object according to the prior art, it has been proposed to form a liquid-repellent or ink-repellent film on the ink blow-out surface of the nozzle plate. As materials that exhibit ink-repelling property, furthermore, there has been known a silicone resin and other fluorine-contained resins. These fluorine-contained resins have a small surface energy and, hence, exhibit excellent resistance against solvents and are hardly wetted by the solutions. The resin of this kind, as a surface-treating agent for the nozzle plate, it can be expected to form a film having an intense ink-repelling property.

According to a prior art for forming a fluorine-contained resin film, a fluorine-contained resin dispersed in a solution is applied by some method onto a substrate and the solvent is vaporized, so that the film of the fluorine-contained resin is melt-formed. In this case, the fluorine-contained resin can be applied by the transfer method, dip-coating method, spin-coating method, roll-coating method, brush-coating method or spray-coating method. Japanese Unexamined Patent Publication (Kokai) No. 2-55140 discloses another method of forming a film of a fluorine-contained resin by relying on the deposition by heat of the fluorine-contained resin.

When the ink-repellent film is to be formed according to the conventional method, long-lasting reliability of the film is important and, particularly, it is important to avoid the deterioration in the ink-repelling property caused by polishing. This is because, the nozzle surfaces are wiped to remove the ink adhered on the nozzle surfaces. However, the ink-repelling property on the nozzle surfaces is deteriorated by the wear resulting from the wiping operation. To avoid deterioration in the ink-repelling property, there can be applied a fluorine-contained resin-containing composite plated film that contains the fluorine-contained resin not only on the surface of the film but also inside the film. The fluorine-contained resin-containing composite plated film is usually formed by depositing a fluorine-contained resin on a substrate by the composite plating that contains the fluorine-contained resin, and by forming the fluorine-contained resin by the heat-treatment. According to this method, the fluorine-contained resin particles are adhered onto the substrate and are then bonded by the heat-treatment. Therefore, a strong film having excellent ink-repelling property is formed compared with only being heat-treated.

Here, a problem arises in that the lower limit in the density of the fluorine-contained resin, distributed on the surface of the fluorine-contained resin-containing composite plated film, varies depending upon the property of the ink that is used. Depending upon the ink, therefore, the distribution of the fluorine-contained resin becomes very dense in the composite plated film. In order to blow out the ink droplets from the nozzles stably and straight, therefore, it becomes necessary to control the density in the distribution of the fluorine-contained resin depending on the ink in the nozzle plate of the ink-jet head.

In the case of the fluorine-contained resin-containing composite plated film, it becomes necessary to adhere the fluorine-contained resin of a predetermined amount onto the surface of the film in order to develop the ink-repelling property on the nozzle surfaces. According to the conventional method, however, the fluorine-contained resin is not adhered in a uniform amount onto the nozzle surfaces, and the ink-repelling property lacks stability from the start.

The ink-repelling property lacks stability from the start on the nozzle surfaces due to the fact that the fluorine-contained resin is adhered in varying amounts onto the nozzle surfaces and, particularly, onto the peripheries of the nozzles. The ink-repelling property on the peripheries of the nozzles is measured as a resistance against the positive pressure. When excellent ink-repelling property is exhibited at the start on the peripheries of the nozzles, the resistance against the positive pressure, which is larger than a predetermined value, is measured. To maintain the ink-repelling property over an extended period of time on the nozzle surfaces, the fluorine-contained resin must be intimately adhered onto the substrate of the nozzle plate on the peripheries of the nozzles and on the nozzle surfaces.

A representative example of the fluorine-contained resin-containing composite plated film will be a fluorine-contained resin-containing nickel composite plating. The fluorine-contained resin-containing nickel composite plating is the one containing, as a matrix, nickel or a nickel alloy that contains fine fluorine-contained resin particles as represented by a polytetrafluoroethylene having a particle diameter of from 0.01 to 100 $\mu$m, which has been widely known as plating technology capable of imparting a lubricating property and a releasing property in addition to a water-repelling property.

In forming the water-repelling film, it has been known that the position of meniscus of the ink is determined depending upon the amount of the water-repelling film that has entered into the ink blow-out nozzles to seriously affect the ink blow-out characteristics. That is, when the water-repelling film that has entered is located near the ink blow-out surface, the ink tends to be erroneously blown out due to mechanical vibration from the external side. When the water-repelling film that has entered is located remote from the ink blow-out surface, bubbles are entrapped after the ink droplets are blown out, and the blow-out characteristics lose stability. It therefore becomes necessary to clarify the boundary position between the water-repelling region and the hydrophilic region determined by the amount of the water-repelling film that has entered, in order to make the position of meniscus constant. Here, if represented by the contact angle $\theta$ of the ink, the region covered with the water-repelling film is, usually, not smaller than 90 degrees. The material of the nozzle plate is exposed on the region that is not covered with the water-repelling film. In general, the material of the nozzle plate will be a metal such as a stainless steel or nickel, a plastic material such as polysulfone, or silicon or a ceramic. On the surfaces of these materials, the contact angle $\theta$ of the ink is roughly not larger than 50 degrees. For the purpose of convenience in this specification, the materials having a contact angle $\theta$ of the ink of not smaller than 90 degrees are defined to be water-repellent and the materials having a contact angle $\theta$ of the ink of not larger than 50 degrees are defined to be hydrophilic. However, the contact angle $\theta$ referred to here may often vary depending on the kind of the solution used for the measurement. In practice, some materials may exhibit the contact angle for the ink of $\theta \leqq 90$ degrees despite their contact angle for the pure water may be $\theta \geqq 90$ degrees on an excellent water-repelling surface. This is because, the contact angle $\theta$ is determined by the mutual actions among the surface tension of the ink (liquid), interfacial tension between the ink (liquid) and the water-repelling surface (solid), and the surface tension of the water-repelling surface (solid). As generally described, the greater the contact angle $\theta$, the better the liquid-repelling property on the surface of the solid material against the liquid. Further, the water-repelling surface having a contact angle for pure water of $\theta \geqq 90$ degrees, generally, exhibits excellent liquid-repelling property even against the ink.

The position of meniscus determined by the boundary position between the water-repelling region and the hydrophilic region, varies greatly depending on the size of the ink flow path, the thickness of the nozzle plate, the size of the ink blow-out nozzles, the kind of the ink, the driving method and the driving force. Therefore, the boundary position is variable, and a suitable technology is required for mass-producing the nozzle plates.

As a method capable of satisfying such a requirement, Japanese Unexamined Patent Publication (Kokai) No. 7-125220 discloses a method in which a film is partly introduced into the ink blow-out nozzles up to a predetermined boundary position between the water-repelling region and the hydrophilic region, where an optimum position of meniscus is obtained, and the film is cured while bringing a photosensitive resin film into contact with the nozzle plate from the back surfaces of the ink blow-out nozzles with the application of a predetermined temperature and pressure. Thereafter, a fluorine-contained resin-containing nickel composite plating is effected and, finally, the film is removed.

In the case of this method, however, the fluorine-contained resin-containing nickel composite plating must enter into a predetermined position in the ink blow-out nozzles so as to be applied thereto. However, the nozzles in an ordinary nozzle plate have a diameter of about several tens of microns, and it is not easy for the plating solution to enter into the nozzles. This is because the fluorine-contained resin-containing nickel composite plating involves bubbles of a hydrogen gas adhered onto the surface of the to-be-adhered material. Therefore, bubbles adhered near the ink blow-out nozzles prevent the plating solution from entering into the nozzles. In other words, the inner surfaces of the ink blow-out nozzles in a nozzle plate are not coated with the fluorine-contained resin-containing nickel composite plating, or the fluorine-contained resin-containing nickel composite plating does not arrive at the predetermined positions in the nozzles if they are coated. That is, according to the method disclosed in Japanese Unexamined Patent Publication (Kokai) No. 7-125220, the boundary position between the water-repelling region and the hydrophilic region undergoes a variation in each ink blow-out nozzle in a piece of nozzle plate, whereby the blow-out characteristics vary for each nozzle, causing the printing to lose stability, which is a problem that must be solved.

According to the method disclosed in Japanese Unexamined Patent Publication (Kokai) No. 7-125220, there further arises another problem. According to this method, the amount of the photosensitive resin film that enters is controlled by the temperature. It is, therefore, difficult to correctly control the boundary position. When the diameter of the ink blow-out nozzles is decreased in order to improve the printing resolution, furthermore, it becomes very difficult to introduce the photosensitive resin film into the nozzles.

In order to solve the above-mentioned problem, there has been proposed a method which forms a boundary between the water-repelling region and the hydrophilic region in the ink blow-out nozzles by the fluorine-contained resin-containing nickel composite plating by using a positive-type liquid photosensitive resin (so-called "resist") instead of using the photosensitive resin film. According to this method, the nozzle plate is immersed in a positive-type photosensitive resin, the interiors of the ink blow-out nozzles are filled with the positive-type photosensitive resin, the nozzle plate is pulled up, and the ink blow-out surface is coated with the positive-type photosensitive resin by the spin-coating method in a state where the ink blow-out surface is faced upwards. This method uses the positive-type liquid photosensitive resin, and makes it easy to fill the ink blow-out nozzles with the positive-type photosensitive resin. Thereafter, the ink blow-out surface is exposed to ultraviolet rays and is developed. In this case, the intensity of the ultraviolet rays and the exposure time are controlled to correctly control the dissolving amount of the positive-type photosensitive resin, i.e., to correctly control the distance from the ink blow-out surface to where the positive-type photosensitive resin is removed. Since the positive-type photosensitive resin serves as a masking means, it is possible to correctly control the amount of the fluorine-contained resin-containing nickel composite plating flowing into the ink blow-out nozzles so as to be applied thereon.

According to this method, however, though the positive-type photosensitive resin can be applied by the spin-coating method, the thickness of the positive-type photosensitive resin does not necessarily become uniform on the ink blow-out surface; i.e., thickness varies depending upon the places, and the positive-type photosensitive resin film may become locally thick. In particular, the film is thickly formed on the outer periphery of the ink blow-out surface. As a result, even though the ink blow-out surface is exposed to ultraviolet rays and is developed, the positive-type photosensitive resin remains on the ink blow-out surface and, particularly, on the outer periphery thereof. Since the fluorine-contained resin-containing nickel composite plating is not applied onto the positive-type photosensitive resin, this portion becomes a defect in the plated film, and the whole ink blow-out surface is not completely covered with the fluorine-contained resin-containing nickel composite plating. Existence of the defectively plated film permits the ink to easily adhere on the ink blow-out surface, preventing the ink droplets from being stably blown out. Besides, the ink adhered on the ink blow-out surface infiltrates from this defective portion into between the underlying substrate and the fluorine-contained resin-containing nickel composite plating, whereby the underlying substrate is corroded, and the fluorine-contained resin-containing nickel composite plating gradually peels off. Finally, therefore, the ink blow-out surface loses the water-repelling property, and it becomes no longer possible to blow out the ink. This is also a problem that must be solved.

In addition to the above-mentioned problems, the method disclosed in Japanese Unexamined Patent Publication (Kokai) No. 7-125220 involves a further problem. When the fluorine-contained resin-containing nickel composite plating is to be formed according to this method, there exists, on the surface of the plated film, a fluorine-contained resin taken into the metal matrix, a fluorine-contained resin simply adsorbed by the surface, and a fluorine-contained resin eluted out from the film due to firing. Accordingly, though the content of the fluorine-contained resin in the metal matrix is from 5 to 50%, the surface of the film is covered with the fluorine-contained resin at a ratio greater than the above value, and the film exhibits properties of the fluorine-contained resin nearly over the whole surface thereof.

When the fluorine-contained resin-containing composite plating is applied on the surface of the nozzle plate to impart water-repelling property thereto, it becomes necessary to effect the wiping operation to remove the ink adhered on the ink blow-out surface by using a blade of rubber or a similar material. Due to the abrasion resulting from this wiping operation, therefore, the water-repelling film is deteriorated adversely affecting the ink blow-out characteristics. Concretely speaking, when the friction is great between the blade and the film during the wiping operation, the fluorine-contained resin only is abraded on the surface of the fluorine-contained resin-containing composite plated film, whereby the durability is deteriorated, and the fluorine-contained resin is observed in an amount nearly equal to its content in the metal matrix on the surface of the nozzle plate which had been initially covered with the fluorine-contained resin. As a result, the ink droplets adhered on the ink blow-out surface are not removed to a sufficient degree by the wiping operation, and the remaining ink droplets solidify. Besides, the solidified ink droplets form nuclei, and the remaining ink droplets are further solidified spreading to the peripheries of the ink blow-out nozzles. Then, the ink blow-out directions are affected to not only deteriorate the printing quality but also making it difficult to blow out the ink. In practice, therefore, it becomes necessary to select an ink that only weakly adheres onto the surface of the nozzle plate, and to effect the wiping operation under a condition where abrasion to the fluorine-contained resin on the surface is minimized. In practice, therefore, the ink used for the ink-jet head has very limited properties. In order to realize an ink-jet head that features high printing quality, therefore, it becomes necessary to provide a nozzle plate that makes it possible to widen the degree of freedom for selecting the ink and features improved reliability in the maintenance over extended periods of time.

Even when the conventional fluorine-contained resin-containing composite plating, inclusive of the one disclosed in Japanese Unexamined Patent Publication (Kokai) No. 7-125220, is applied onto the ink blow-out surface of the nozzle plate, it is not possible to completely prevent the ink from remaining on the ink blow-out surface. Being affected by the ink remaining on the peripheries of the ink blow-out nozzles, therefore, the direction of blowing out the ink droplets loses stability, the remaining ink coagulates and dries to clog the ink blow-out holes, and the blow out of the ink cannot be continued any longer.

To cope with the adhesion of the ink, the ink-jet printer is equipped with a cleaning mechanism for wiping the ink blow-out surface using a blade made of an elastic rubbery material such as polyurethane rubber as disclosed in, for example, Japanese Unexamined Patent Publication (Kokai) No. 5-201014. When the ink blow-out surface is wiped with this blade many times, however, the water-repelling film is gradually worn out, and the water-repelling property disappears, causing the directions in which the ink droplets are blown out to be changed and making it difficult to normally effect printing in the same way as described above.

DISCLOSURE OF THE INVENTION

It is therefore an object of the present invention to provide a nozzle plate for an ink-jet head which does not permit the ink to stay adhered on the peripheries of the ink blow-out nozzles after the blow out of the ink and enables the ink droplets to be stably blown out straight by solving the above-mentioned various problems inherent in the prior art.

It is another object of the present invention to provide a nozzle plate for an ink-jet head which maintains the ink-repelling property on the nozzle surfaces from the first time and for extended periods of time, enables the ink droplets to be stably blown out straight without permitting the ink to stay adhered on the peripheries of the nozzles or on the nozzle surfaces, maintaining reliability in the printing quality for extended periods of time as a result of stably adhering the fluorine-contained resin on the peripheries of the nozzles and on the nozzle surfaces of the ink-jet head.

It is a further object of the present invention to provide a nozzle plate for an ink-jet head by permitting a fluorine-contained resin-containing nickel composite plating solution to easily infiltrate into the ink blow-out nozzles to keep constant the boundary position between the water-repelling region and the hydrophilic region in the ink blow-out nozzles in a step of applying the fluorine-contained resin-containing nickel composite plating which is a water-repelling film on the ink blow-out surface and in the ink blow-out nozzles of the nozzle plate.

It is a still further object of the present invention to provide a nozzle plate for an ink-jet head in which the boundary position between the water-repelling region and the hydrophilic region remains constant in the ink blow-out nozzles, and the ink blow-out surface is coated with a defect-free fluorine-contained resin-containing nickel composite plating.

It is a yet further object of the present invention to provide a nozzle plate for an ink-jet head maintaining excellent reliability for extended periods of time as a result of improving the durability of the fluorine-contained resin-containing composite plating formed on the ink blow-out surface of the nozzle plate.

It is a further object of the present invention to provide a nozzle plate for an ink-jet head which maintains the water-repelling property at all times and stabilizes the ink blow-out characteristics by suppressing the deterioration in the water-repelling property on the ink blow-out surface.

It is another object of the present invention to provide a nozzle plate for an ink-jet head which features excellent reliability in the maintenance for extended periods of time by concretely demonstrating a method of patterning the fluorine-contained resin-containing composite plating film that facilitates the removal of the ink droplets adhered near the ink blow-out nozzles in the ink blow-out surface of the nozzle plate.

It is an object of the present invention to provide a method of producing the above-mentioned nozzle plate.

It is a still further object of the present invention to provide an ink-jet head which expands the degree of freedom for selecting the ink and realizes excellent printing quality by using the above-mentioned nozzle plate.

The above and other objects of the present invention-will be easily understood from the following detailed description.

According to one aspect of the present invention, there is provided a nozzle plate for an ink-jet head used in an ink-jet type recorder, comprising a flat plate member which defines an ink blow-out surface on one main surface thereof and has a plurality of ink blow-out nozzles penetrating at predetermined positions; wherein said ink blow-out surface and portions on the inner surfaces of said ink blow-out nozzles neighboring said ink blow-out surface, have, at least partly, an ink-repelling layer of a fluorine-contained resin-containing electrolytic or non-electrolytic composite plating.

In the nozzle plate for the ink-jet printer of the present invention, the ink-repelling layer preferably has a distribution in the content of the fluorine-contained resin.

Preferably, furthermore, the ink-repelling layer has a distribution in the content of the fluorine-contained resin in the direction of thickness of the film, and contains the fluorine-contained resin in large amounts on the surface region.

Preferably, the ink-repelling layer is finely finished on its surfaces in at least the region of said ink blow-out surface. In this case, the ink-repelling layer has a center average surface roughness Ra of, preferably, from 0.02 to 0.1 $\mu$m.

It is further desired that the ink-repelling layer has a rugged surface in the region of the ink blow-out surface. It is here desired that the height of ruggedness in the surface of the ink-repelling layer is not smaller than 0.01 $\mu$m but is not larger than the thickness of the ink-repelling layer.

Preferably, furthermore, the ink-repelling layer is formed on the ends in the inner surfaces of the ink blow-out nozzles neighboring the ink blow-out surface and on the peripheries surrounding the ink blow-out nozzles on the ink blow-out surface. In this case, it is desired that the ink-repelling layer has a step in the outer peripheries of the nozzles, the step being larger than the thickness of the ink-repelling layer.

In the nozzle plate for the ink-jet head according to the present invention, furthermore, it is desired that the ink-repelling layer has a thickness of at least 2.0 $\mu$m.

It is desired that the ink-repelling layer is continuing from the ink blow-out surface to the inner surfaces of the ink blow-out nozzles.

According to another aspect of the present invention, there is provided a method of producing a nozzle plate for an ink-jet head used in an ink-jet type recorder, comprising a flat plate member which defines an ink blow-out surface on one main surface thereof and has a plurality of ink blow-out nozzles penetrating at predetermined positions; wherein the flat plate member is machined to form the ink blow-out nozzles therein at predetermined positions, and an ink-repelling layer of a fluorine-contained resin-containing composite plating is formed at least partly on the ink blow-out surface and on the portions on the inner surfaces of the ink blow-out nozzles neighboring the ink blow-out surface, based on the electrolytic plating method or the non-electrolytic plating method.

In the method of producing a nozzle plate for an ink-jet head according to the present invention, it is desired that the flat plate member is heat-treated at a temperature higher than the melting point of the fluorine-contained resin after the step of plating based on the electrolytic plating method or the non-electrolytic plating method. Preferably, the flat plate member is heat-treated at a temperature higher than the melting point of the fluorine-contained resin by 10 to 50° C.

Preferably, furthermore, after the ink blow-out nozzles have been formed by machining in the flat plate member at predetermined positions, the flat plate member is immersed in a plating bath while selectively exposing only those portions where the ink-repelling layer is to be formed, in order to execute the step of plating based on the electrolytic plating method or the non-electrolytic plating method.

Here, the plating bath preferably contains particles of the fluorine-contained resin and a plating metal.

It is desired that ultrasonic waves are applied to the plating bath at least temporarily in the step of plating. In this case, the ultrasonic waves are applied preferably by inserting an ultrasonic wave-generating terminal in the plating bath, or the ultrasonic waves are applied by introducing the plating bath or a container containing the plating bath into a vessel equipped with an ultrasonic wave-generating mechanism.

According to the method of the present invention, the flat plate member is selectively exposed at only those portions on where the ink-repelling layer is to be formed, wherein lithography technology is employed for:

covering predetermined portions of the flat plate member with a photosensitive resist material; and exposing the resist material to radiations of a predetermined pattern; and wherein the resist material is removed by developing from either the exposed regions or unexposed regions by utilizing the positive action or the negative action, thereby to selectively expose only those portions on where the ink-repelling layer is to be formed.

Preferably, the step of exposing the resist material is conducted by being divided into the following two steps of:

pre-exposing the flat plate member in the presence of a masking means capable of interrupting the irradiation of radiations on the ink blow-out surface that includes the ink blow-out nozzles, so that the resist material having a relatively large thickness and existing on the outer peripheries of the ink blow-out nozzles is selectively exposed to the pattern of radiations; and exposing the whole surface of the resist material to the pattern of radiations after the masking means has been removed.

It is further desired that the step for exposing the resist material is conducted while controlling the intensity of the radiations and the exposure time, thereby to adjust the depth of the ink-repelling layer extending into the inner surfaces of the ink blow-out nozzles.

Preferably, the resist material is a positive-type liquid resist material having a viscosity of not larger than 100 cps and is applied onto the surface of the flat plate member by the spin-coating method.

Preferably, the step of plating based on the electrolytic plating method or the non-electrolytic plating method is conducted while controlling the thickness of the plating, so that the ink-repelling layer has a distribution in the content of the fluorine-contained resin in the direction of thickness thereof and that the fluorine-contained resin is contained in large amounts in the surface region.

It is further desired that the ink-repelling layer that is formed is finely finished for its surfaces in at least the region of the ink blow-out surface. In this case, the fine surface finishing is conducted under such a condition that the center surface roughness Ra of the ink-repelling layer lies over a range of from 0.02 to 0.1 $\mu$m. It is further desired that the fine surface finishing is effected relying upon at least one working technology selected from the group consisting of mirror-surface grinding, superfinishing, honing, lapping and electrolytic polishing.

It is desired to impart roughness, i.e., recesses and protrusions, to the surface of the ink-repelling layer in the region of the ink blow-out surface. In this case, it is desired that the roughness is imparted under such a condition that the roughness imparted to the surface of the ink-repelling layer has a height of not smaller than 0.01 $\mu$m but not larger than the thickness of the ink-repelling layer. In particular, it is desired that the roughness is imparted by machining the surface of the flat plate member on the side of the ink blow-out surface prior to forming the ink-repelling layer.

It is desired that the ink-repelling layer is selectively formed on the end portions in the inner surfaces of the ink blow-out nozzles neighboring the ink blow-out surface and on the outer peripheries of the ink blow-out nozzles in the ink blow-out surface. In this case, it is desired that the ink-repelling layer has a step in the outer peripheries of the nozzles, the step being greater than the thickness of the ink-repelling layer.

According to a further aspect of the present invention, there is provided an ink-jet head used in an ink-jet type recorder, comprising an ink chamber, a nozzle plate of a flat plate member which defines an ink blow-out surface on one main surface thereof and has a plurality of ink blow-out nozzles penetrating at predetermined positions so as to be communicated with said ink chamber, and a pressure generator capable of flying the ink droplets from the nozzles of the nozzle plate toward the recording medium by applying a pressure to the ink in the ink chamber; wherein the ink blow-out surface and portions on the inner surfaces of the ink blow-out nozzles neighboring the ink blow-out surface, have, at least partly, an ink-repelling layer of a fluorine-contained resin-containing electrolytic or non-electrolytic composite plating.

BEST EMBODIMENT FOR CARRYING OUT THE INVENTION

As briefly described above, the present invention is concerned with a nozzle plate for an ink-jet head, to a method of producing the same and to an ink-jet head. Hereinafter, preferred embodiments of the present invention will be described in detail.

Figure 1:
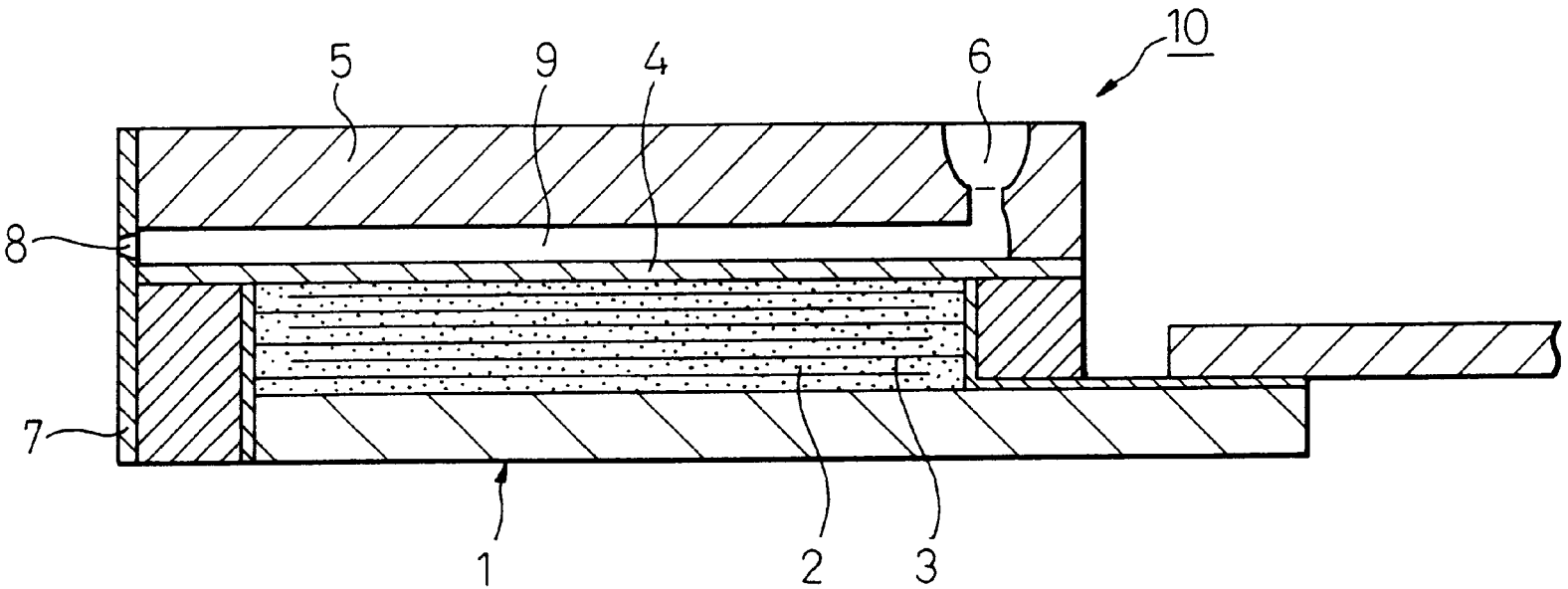
FIG. 1 is a sectional view illustrating an ink-jet head according to a preferred embodiment of the present invention.

In an embodiment of the invention, the ink-jet head body may be the one having a constitution generally used in this field of art as described already in the above-mentioned prior art or may be the one that is modified. According to a preferred embodiment of the present invention, the ink-jet head uses a piezo-electric element that is shown, for example, in FIG. 1 in cross section. In FIG. 1, the ink-jet head 10 is constituted by a substrate (also called "base" or "bed") 1 forming the lower part of the head 10, a piezoelectric element 2 placed on the substrate 1 and driven, when required, by an electrode plate 3 contained therein, an oscillation plate 4 which is deformed by the piezoelectric element to transmit a pressure wave to the ink chamber (ink passage) 9, a closure 5 which constitutes the upper part of the head 10 and forms an ink chamber 9 together with the oscillation plate 4 and other members, an ink-feed port 6 formed in the closure 5, and a nozzle plate 7 of the invention located on the front surface of the head 10 (on the side of the to-be-recorded medium) and includes ink blow-out nozzles 8. The word "ink chamber-constituting member" referred to in this specification stands for a member that constitutes the ink chamber 9 among such members as the above-mentioned substrate 1, piezoelectric element 2, oscillation plate 4, closure 5 and nozzle plate 7 (member of which the surface at least partly comes in contact with the ink).

Figure 2:
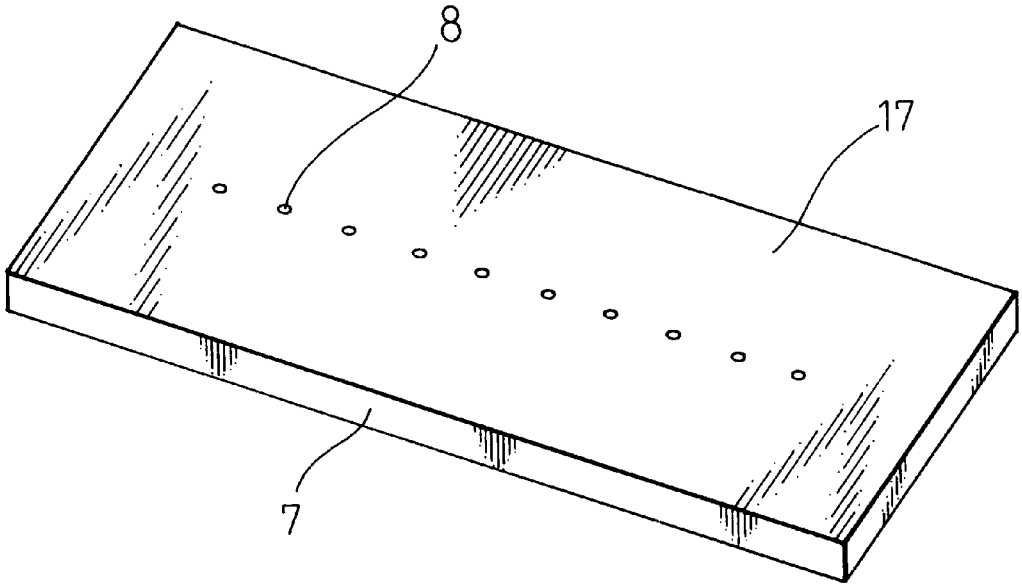
FIG. 2 is a perspective view of a nozzle plate of the present invention used for the ink-jet head shown in FIG. 1.

As will be understood from a perspective view of FIG. 2, the nozzle plate 7 according to the present invention has a structure in which a plurality of nozzles 8 are arranged in line or are, as required, arranged in plural lines to enhance the ejection efficiency. The upper surface (on the side of the to-be-recorded medium) 17 of the nozzle plate 7 that is shown is the ink blow-out surface of the nozzle plate that is frequently referred to in this specification, and the back side thereof is the ink blow-out back surface. The nozzle plate will be described in further detail below.

By using the ink-jet head 10, the ink is injected from the head onto the to-be-recorded medium (not shown) in a manner as described below. First, when a current is supplied to the electrode plate 3, a voltage is applied to the neighboring piezoelectric element 2 which, then, expands. The piezoelectric element 2 that is expanded lifts up the oscillation plate 4 arranged thereon in a neighboring manner. As the oscillation plate 4 is lifted up, the volume of the ink chamber 9 contracts (receives the pressure wave). Then, the ink in the ink chamber 9 is blown out through the nozzle 8 which is the sole outlet from the ink chamber, and flies in the form of ink droplets toward the recording medium. Though the specification deals with the ink-jet head of the charge-controlled recording type by utilizing the piezoelectric element and the nozzle plate of the invention, the invention can be also applied, as required, to the one of the bubble-jet type or any other type.

The members constituting the ink-jet head 10 can be made of various materials depending upon the characteristics and factors of the head. For example, other members constituting the substrate 1, closure 5 and housing of the head can be, preferably, constituted by using various plastic materials. Though not limited to those described below only, preferred examples of the plastic material include acrylic resin, epoxy resin, polyethylene, polypropylene, polyester, polyacetal, polycarbonate, polyamide, polyimide, polystyrene, styrene-butadiene resin, acrylonitrile-butadiene-styrene (ABS) resin, ethylene-propylene rubber, polymethylpentene, polyphenylene sulfide, polyether ether ketone and liquid crystal polymer. These plastic materials may be used in a single kind or in combination, as required. Or, the plastic materials may be used depending upon the constituent members. Or, the plastic materials may be used in combination with other materials such as a metal material, an alloy material, or a steel such as a stainless steel, nickel, an alloy thereof, or a ceramic material such as alumina, zirconia, or any other material.

As required and preferably, furthermore, the above-mentioned plastic materials may contain organic and inorganic fillers, such as silica, carbon black, titanium oxide, graphite, molybdenum sulfide, fluorine-contained resin, clay, talc, silicate and carbonate in order to increase the strength and to prevent deformation such as warping. As required, these fillers may be used singly or in combination. Usually, these fillers are used in the form of a powder or flakes being uniformly dispersed in the plastic material that constitutes the member, the amount of addition being varied over a wide range depending upon the desired effect and the kind of the filler.

The piezoelectric element 2 can be constituted by a piezoelectric material such as lead zirconate titanate (PZT) that is usually used in this field of art. The electrode plate 3 buried in the piezoelectric element 2 can be formed of, for example, gold or the like that is buried at the time of forming the piezoelectric element by the lamination method. The oscillation plate 4 can be, usually, constituted by a diaphragm made of a metal material such as nickel or the like.

The nozzle plate 7 can be constituted by using various materials such as a metal material, a ceramic material or the like material by taking the machining of nozzles 8 into consideration. Though not limited to those described below only, examples of the material suited as the nozzle plate include simple metals such as titanium, chromium, iron, cobalt, nickel, copper, zinc, tin and gold, alloys such as nickel-phosphorus alloy, tin-copper-phosphorus alloy (phosphor bronze), copper-zinc alloy (BS), and a stainless steel (SUS), and ceramic materials. The shape and size of the nozzle plate 7 may comply with those of the normally used nozzle plate, the thickness being, usually, for example, from about 50 to about 100 μm. The nozzle plate can be produced in compliance with the generally employed method of producing the nozzle plates.

In a first embodiment of the present invention, the nozzle plate for the ink-jet head is a flat plate member having the ink blow-out surface on one side thereof. The nozzle plate having ink blow-out nozzles penetrating through the flat plate member at predetermined positions for blowing out the ink, is coated with a fluorine-contained resin(fluororesin)-containing non-electrolytic composite plating by the surface-treating method. In the nozzle plate of the present invention, furthermore, the amount of the fluorine-contained resin in the surface of the fluorine-contained resin-containing non-electrolytic composite plating is adjusted based on the thickness of the composite plating.

According to the present invention, the fluorine-contained resin-containing non-electrolytic composite plating is applied, preferably, by masking the ink blow-out back surface of the nozzle plate and the interior of the ink blow-out nozzles with a suitable masking means and, then, coating the nozzle plate with the fluorine-contained resin-containing composite plating. The method of applying the fluorine-contained resin-containing composite plating is a known surface-treating method, and in which the plating grows while trapping the primary particles of the fluorine-contained resin therein. The fluorine-contained resin-containing non-electrolytic composite plating is also called "fluorine-contained resin eutectoid plating".

According to the present invention, the fluorine-contained resin-containing non-electrolytic composite plating is applied by immersing the nozzle plate in a suitable plating bath containing a matrix metal and a fluorine-contained resin. As the matrix metal, there can be used a metal such as nickel, copper, silver, zinc or tin, or an alloy thereof. Preferably, there can be used nickel (Ni) or a nickel alloy such as nickel-cobalt alloy (Ni—Co), nickel-phosphorus alloy (Ni—P) or nickel-boron alloy (Ni—B) from the standpoint of surface hardness and excellent abrasion resistance. As the eutectoid fluorine-contained resin, there can be used a high molecular compound containing a fluorine atom in the molecular structure, such as ethylene tetrafluoride resin (polytetrafluoroethylene resin, hereinafter often abbreviated as "PTFE"), ethylene tetrafluoride-propylene hexafluoride copolymer resin (hereinafter often abbreviated as "FEP"), carbon monofluoride (fluorinated graphite), polyperfluoroalkoxybutadiene (hereinafter abbreviated as "PFA"), polyfluorovinylidene or polyfluorovinyl singly or in combination. Desirably, these materials are used in such amounts that the content of the fluorine-contained resin in the eutectoid plating is within a range of from 10 to 50% by volume.

When the above-mentioned material is used in the step of composite plating in a non-electrolytic nickel-plating bath containing hypophosphite, borohydride or hydrazine as a reducing agent under predetermined conditions, fine particles of the fluorine-contained resin precipitate together with the matrix metal that precipitates in a dispersing manner, making it possible to obtain a desired composite plating. As will be described later, the plating is a functionally excellent film having properties inherent in the fluorine-contained resin and properties of the matrix metal in combination. As required, the electroplating may be employed by using Watts bath or sulfamic acid bath instead of the non-electrolytic plating to obtain the action and effect intended by the present invention.

When the nozzle plate coated with the fluorine-contained resin-containing composite plating is heat-treated at a temperature higher than the melting point of the fluorine-contained resin (e.g., about 350° C. when the fluorine-contained resin is PTFE), the fluorine-contained resin partly elutes on the surface of the plated film since the fluorine-contained resin melting in the plated film is thermally expanded more than the matrix metal used for the composite plating. Therefore, the amount of the fluorine-contained resin eluting on the surface of the plated film varies depending upon the absolute amount of the fluorine-contained resin in the plated film. That is, the density of the fluorine-contained resin eluted on the surface of the plated film varies depending on the thickness of the plated film.

Figure 3:
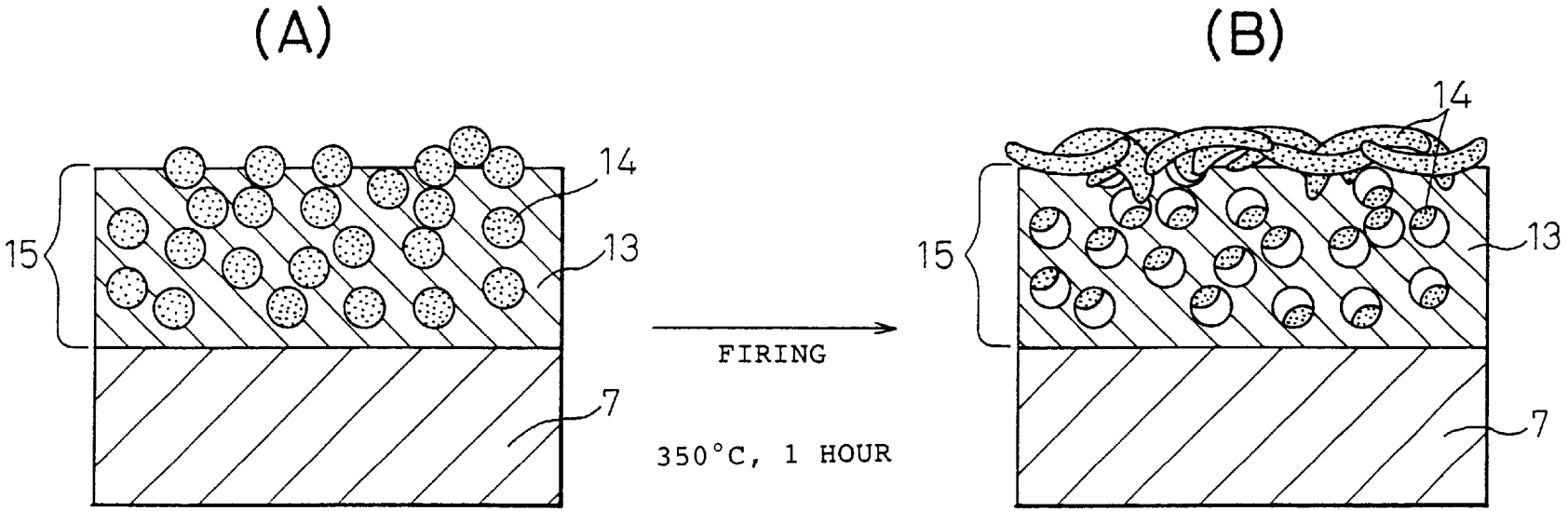
FIG. 3 is a sectional view schematically illustrating a mechanism for giving the ink-repelling property in the fluorine-contained resin-containing composite plating on the nozzle plate of the present invention.

The mechanism of generating and controlling the density in the distribution of the fluorine-contained resin can be explained with reference, for example, to FIG. 3. First, the fluorine-contained resin-containing composite plating is formed according to the surface-treating method of the present invention; i.e., a composite plating 15 is formed on the nozzle plate 7 as shown in FIG. 3(A). The plated film 15 has a structure in which particles of the fluorine-contained resin (ethylene tetrafluoride resin PTFE in this case) are uniformly dispersed in the matrix metal 13 (nickel in this case). Then, the coated film 15 is fired at a temperature of, for example, 350° C. for one hour so that the fluorine-contained resin partly elutes on the surface of the coated film. As shown in FIG. 3(B), therefore, the fluorine-contained resin 14 that has migrated through the matrix metal 13 in the coated film 15 deposits in a concentrated manner on the surface of the film 15. In the present invention, the thus formed film 15 is called "liquid-repelling film", "water-repelling film" or "ink-repelling film" to reflect its function.

Therefore, the density of the fluorine-contained resin on the surface of the fluorine-contained resin-containing composite plated film can be controlled relying on the thickness of the fluorine-contained resin-containing composite plated film. By forming the fluorine-contained resin-containing composite plated film on the ink blow-out surface of the nozzle plate, the density of the fluorine-contained resin in the surface of the fluorine-contained resin-containing composite plating being controlled based on the ink that is used, therefore, it is allowed to stably blow out the ink droplets straight toward the to-be-recorded medium without permitting the ink to stay adhered around the ink blow-out nozzles after the ink is blown out.

The method of treating the surface of the nozzle plate for the ink-jet head according to the embodiment will now be described with reference to the accompanying drawings.

Figure 4:
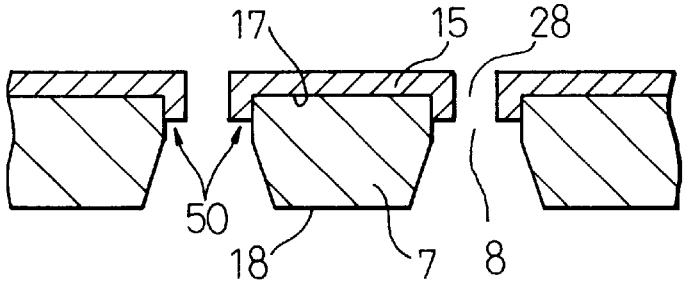
FIG. 4 is a sectional view illustrating he nozzle plate according to a preferred embodiment of the present invention.

FIG. 4 is a sectional view schematically illustrating, on an enlarged scale, the structure of a nozzle plate for an ink-jet head and, particularly, the periphery of the ink blow-out nozzles according to the embodiment. The nozzle plate 7 for the ink-jet head has the liquid-repelling film 15 formed on the ink blow-out surface 17 thereof. As shown, furthermore, the liquid-repelling film 15 is partly entering into the ink blow-out nozzles 8 to form a boundary 50 of ink-repelling region (formed by the ink-repelling film)/ink-compatible region (formed by the nozzle plate). Reference numeral 28 denotes the ink blow-out apertures in the nozzle plate. This structure stabilizes the position of meniscus at the time when the ink is blown out.

The water-repelling film 15 shown in FIG. 4 can be formed by a method shown in a series in FIGS. 5(A) to 5(C).

Referring, first, to FIG. 5(A), a positive-type photosensitive resin 40 is applied onto the ink blow-out back surface 18 and is introduced into the ink blow-out through holes of the nozzle plate 7 that has a length of 50 mm, a width of 15 mm, a thickness of 0.1 mm, and circular through holes (designated at 8 in FIG. 4) for blowing the ink, and is, then, cured. The nozzle plate 7 used here is a nickel plate obtained by the electroforming. However, the nozzle plate may be a stainless steel plate in which the ink blow-out holes are formed by, for example, plastic working or may be made of a ceramic obtained by an injection-molding method.

In order for the ink to be smoothly supplied and blown out straight, the through holes for blowing the ink is tapered in cross section and, concretely speaking, has a diameter of 35 μm in the ink blow-out surface 7 and has a diameter of 100 μm in the ink blow-out back surface 18 which is on the opposite side. The nozzle plate 7 used in this embodiment has a total of 22 ink blow-out nozzles 8.

The positive-type photosensitive resin 40 is a liquid resist having a low viscosity or, concretely, having a viscosity of not larger than 100 centipoises (cps) since it must be introduced up to the ink blow-out surface 17. Though not diagramed, it is desired that the positive-type photosensitive resin 40 is introduced in a state where the ink blow-out surface 17 is pressed onto an elastic material such as a silicone rubber, so that the resin will not flow onto the ink blow-out surface 17. In this state, the resin is baked at a temperature of from 60 to 100° C. and is cured.

In this embodiment, the positive-type photosensitive resist, OFPR-800 (trade name), having a viscosity of 30 cps produced by Tokyo Oka Co. is used as a photosensitive resin, and is dropped on the ink blow-out back plane 18 in a state where the ink blow-out surface 17 is pressed onto the silicone rubber sheet, and is further applied and introduced by the spin-coating method.

Next, though not diagramed, the nozzle plate 7 is irradiated on its whole surface with an ultraviolet ray (wavelength of 365 nm) from the side of the ink blow-out surface 17, and is immersed in an alkaline developing solution NMD-W, which is for use with OFPR-800 (trade name), to be developed. As a result of developing, the portions exposed to ultraviolet rays are dissolved and removed to assume a state shown in FIG. 5(B). In this case, the distance L from the ink blow-out surface 17 to the positive-type photosensitive resin 40 after developing can be correctly controlled based on the intensity of ultraviolet ray and the exposure time. In this embodiment, the intensity of ultraviolet ray is set to be 10 $mW/cm^2$, the exposure time is set to 5 seconds, and the distance L from the ink blow-out surface 17 to the photosensitive resin 40 is set to be 5 μm.

Next, the fluorine-contained resin-containing composite plating is effected. Referring to FIG. 5(C), the liquid-repelling film 15 is formed on the ink blow-out surface of the nozzle plate 7. After the completion of the composite plating, the positive-type photosensitive resin 40 that was used as a masking means in the preceding step and that is now unnecessary, is removed by dissolution using a solvent. Acetone is used in this embodiment. After the positive-type photosensitive resin 40 is removed by dissolution, the whole nozzle plate 7 is introduced into a heating furnace and is heat-treated at a temperature of from about 350 to 400° C.

The fluorine-contained resin thermally expands more than nickel. During the treatment with heat, therefore, the fluorine-contained resin in the film partly elutes out onto the surface of the film. Therefore, the amount of the fluorine-contained resin eluting out on the surface of the film varies depending upon the absolute amount of the fluorine-contained resin in the film, and the density in the distribution of the fluorine-contained resin on the surface of the film can be controlled by adjusting the thickness of the plated film.

This embodiment employs the non-electrolytic composite nickel plating (available as "NIMFLON" (trade name) from Uemura Kogyo Co.) that contains an ethylene tetrafluoride resin (PTFE) as a fluorine-contained resin, and sets the temperature of the plating bath to be 75° C. The plating rate at the plating bath temperature of 75° C. is about 4.5 μm of the plated film per one hour. The plating thickness of 3.5 μm is accomplished by immersing the nozzle plate in the plating solution for about 47 minutes.

Through such a series of steps, the nozzle plate 7 for the ink-jet head, in which the liquid-repelling film 15 enters into the ink blow-out nozzles 8 to form a boundary 50 of ink-repelling region/ink-compatible region, and the position of the boundary 50 due to the introduction of the liquid-repelling film 15 remains constant is accomplished, as described with reference to FIG. 4.

In order to make sure of the effect of the embodiment, a nozzle plate on which the fluorine-contained resin-containing composite plating was applied maintaining a thickness of 1.0 μm and a nozzle plate on which the fluorine-contained resin-containing composite plating was applied maintaining a thickness of 3.5 μm, were prepared according to the procedure described above, and the surfaces of the nozzle plates were observed by using a scanning-type electron microscope. It was confirmed that the larger the thickness of the fluorine-contained resin-containing composite plating, the larger the density of the fluorine-contained resin eluted out on the surface of the plated film.

Figure 6:
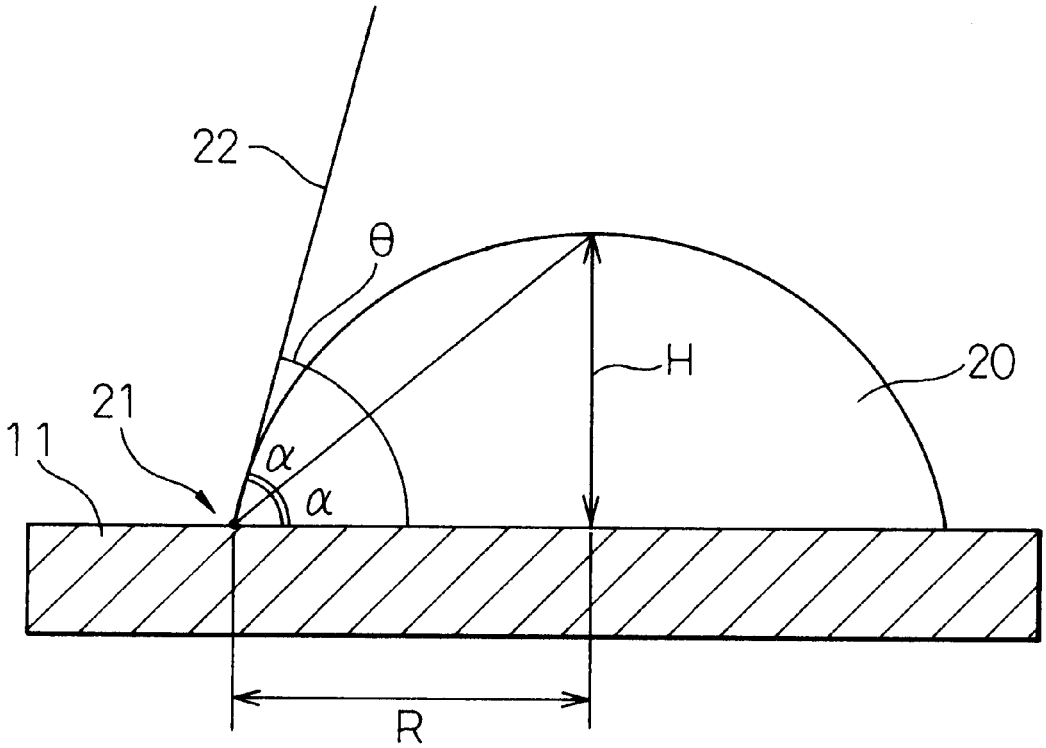
FIG. 6 is a schematic view illustrating a method of measuring the contact angle used for evaluating the ink-repelling property.

The nozzle plate on which the fluorine-contained resin-containing composite plating was applied maintaining a thickness of 1.0 μm and the nozzle plate on which the fluorine-contained resin-containing composite plating was applied maintaining a thickness of 3.5 μm, were prepared in the same manner as described above and, then, the contact angles were measured between the surfaces of the nozzle plates and the ink. It was confirmed that the contact angle was 57.5 degrees in the case of the nozzle plate having the plated film of a thickness of 1.0 μm, and the contact angle was 76.9 degrees in the case of the nozzle plate having the plated film of a thickness of 3.5 μm. The "contact angle" refers to the contact angle of the liquid which is a general reference for evaluating the wettability on the surface of a solid material. In this embodiment, the contact angle was measured as shown in FIG. 6 by using pure water as a liquid as stipulated under JIS K-6800. That is, a plastic member 11 was so secured that its surface was horizontally oriented, and a droplet of pure water 20 was allowed to fall on the surface. Immediately after the droplet of pure water fell, the angle subtended by a tangential line 22 on the vertical cross section of the water droplet and the plastic member 11 at a point 21 where the surface of the water droplet came in contact with the surface of the plastic member, was regarded as the contact angle θ. The contact angle θ can be found according to the following formulas, $$\tan \alpha = H/R$$

$$\text{contact angle } \theta = 2 \times \alpha$$

where H is the height of pure water 20 from the surface where it is contacting to the plastic member 11, and R is a radius of the surface of pure water 20 contacting the plastic member 11.

The nozzle plate on which the fluorine-contained resin-containing composite plating was applied maintaining a thickness of 1.0 μm and the nozzle plate on which the fluorine-contained resin-containing composite plating was applied maintaining a thickness of 3.5 μm, were prepared in the same manner as described above. By using these nozzle plates, ink-jet heads were assembled as shown in FIG. 1, and ink was actually added to conduct the blow-out testing. The head using the nozzle plate having the plated layer of the thickness of 3.5 μm blew out the ink stably, but the head using the nozzle plate having the plated layer of the thickness of 1.0 μm blew out the ink in the deviated directions.

According to the method of treating the surface of the nozzle plate for the ink-jet head of the present invention as will be understood from the foregoing results, the fluorine-contained resin-containing composite plated film, of which the density in the distribution of fluorine-contained resin is controlled depending on the ink that is used, is formed on the ink blow-out surface of the nozzle plate. It is thus made possible to obtain a nozzle plate for the ink-jet head that features excellent printing quality by stably blowing out the ink droplets straight without permitting the ink to stay adhered on the peripheries of the ink blow-out nozzles after the ink is blown out.

In a second embodiment of the present invention, the fluorine-contained resin-containing composite plated film is formed as an ink-repelling layer maintaining a thickness of, preferably, at least 2.0 μm around the ink blow-out nozzles and on the ink blow-out surface of the nozzle plate for the ink-jet head. Though the upper limit of the thickness of the fluorine-contained resin-containing composite plating is not particularly limited, the thickness should not be so large as to impair the flying of ink blown out from the nozzles.

When the fluorine-contained resin-containing composite plated film is formed having a thickness as described above according to the present invention, it is desired to conduct the heat-treatment after the film has been formed and, particularly, to fire the nozzle plate having the ink-repelling layer formed by the fluorine-contained resin-containing composite plating at a temperature higher than the melting point of the fluorine-contained resin by not less than 10° C. It is further desired to conduct the firing at a temperature higher than the melting point of the fluorine-contained resin by not less than 20° C. Though the upper limit of the temperature of the firing is not particularly limited, it is desired that the firing is conducted at a temperature higher than the melting point of the fluorine-contained resin by not more than 50° C.

When the ink-repelling layer is formed by the fluorine-contained resin-containing composite plating, the fluorine-contained resin contained in the ink-repelling layer elutes out on the surface of the nozzle late due to the firing, and the surface of the nozzle late is covered with the fluorine-contained resin in the form of a cord.

Excellent ink-repelling property is obtained when the thickness of the ink-repelling layer formed by the fluorine-contained resin-containing composite plating is not smaller than 2.0 μm. When dispersion in the thickness of the film is taken into consideration, however, it is desired that the thickness of the ink-repelling layer is not smaller than 3.0 μm.

The surface of the nozzle plate covered with the cord-like fluorine-contained resin exhibits the ink-repelling property offering excellent resistance against the positive pressure. Upon forming the ink-repelling layer around the nozzles and on the surface of the nozzle plate by the fluorine-contained resin-containing composite plating maintaining a thickness of not smaller than 2.0 μm and, preferably, not smaller than 3.0 μm, therefore, it is possible to obtain reliability in the printing quality not only at the start but also for long periods of time as a result of stably blowing out the ink droplets straight without permitting the ink to stay adhered around the ink blow-out nozzles after the ink is blown out. This will now be concretely described with reference to an ink-jet head equipped with the nozzle plate.

The ink-jet head may have a constitution shown in, for example, FIG. 1 as described earlier. That is, referring to FIG. 1, a paste-like electrode plate 3 comprising silver and palladium as chief components is laminated on a thin paste-like piezoelectric plate (piezoelectric element) having a thickness of about 20 μm and exhibiting piezoelectric effect and, then, the piezoelectric element 2 and the electrode plate 3 are successively laminated thereon in plural numbers, followed by firing to form a laminated-layer piezoelectric material. The electrode plates 3 are formed on both surfaces of each piezoelectric element 2, and are exposed at the ends to the collectors (not shown). The collectors can be formed by successively depositing chromium, nickel and gold on the laminated-layer piezoelectric material relying on a thin film-forming means such as vacuum vaporization method. When a voltage is applied across the collectors formed at both end surfaces of the laminated-layer piezoelectric material, an electric field is generated in every piezoelectric element 2. Therefore, every piezoelectric element 2 extends by a very small size in the direction of thickness thereof. Upon integrating these changes, therefore, the laminated-layer piezoelectric material undergoes a displacement in a required amount in the direction of thickness.

The nozzle plate is produced by, for example, forming the ink-repelling film on the predetermined portions on a nickel nozzle plate obtained by the electroforming method relying on the eutectoid plating using a plating solution containing fine particles of the fluorine-contained resin. Referring again to FIG. 3, the state of the ink-repelling film right after it is plated is as shown in a sectional view (A). The ink-repelling plated film 15 is constituted by particles 14 of PTFE which is a fluorine-contained resin and a nickel medium 13 in which the particles are dispersed. The PTFE particles 14 are mostly present in the film 15 in which nickel serves as a medium, and are present in very small amounts on the surface thereof compared to those in the plated film.

When the nozzle plate on which the ink-repelling film is plated is fired at a temperature of 350° C. which is higher by 23° C. than 327° C. which is the melting point of the PTFE, the PTFE present in the ink-repelling film melts and elutes out in the form of a cord on the nozzle plate. FIG. 3(B) schematically illustrates the PTFE particles 14 in two kinds of states. It will be understood that the PTFE particles 14 assume a cord-like form on the surface of the ink-repelling film 15.

The cord-like PTFE eluted out on the surface of the ink-repelling film, i.e., on the ink blow-out surface of the nozzle plate, stems from the PTFE particles contained in the film. On the same surface, therefore, the amount of the cord-like PTFE that elutes out inevitably increases with an increase in the thickness of the plated eutectoid film.

In a third embodiment of the present invention, the fluorine-contained resin-containing nickel composite plating is applied onto the nozzle plate for the ink-jet head, the nozzle plate comprising a flat plate member having an ink blow-out surface on one surface thereof and having ink blow-out nozzles (ink blow-out holes) formed penetrating through the flat plate member at predetermined positions to blow out the ink. Here, it is desired that the nozzle plate for the ink-jet head is immersed in a plating bath (hereinafter often referred to as a "plating solution") and, then, ultrasonic waves are applied to the plating bath.

In this embodiment, it is desired that the regions where the fluorine-contained resin-containing nickel composite plating is to be applied are on the ink blow-out surface of the nozzle plate and in the ink blow-out nozzles as described in the foregoing embodiment.

A step for applying ultrasonic waves to the plating bath after the nozzle plate has been immersed in the plating bath, can be conducted according to various methods. It is, however, desired to insert an ultrasonic wave-generating terminal in the plating bath to generate ultrasonic waves, or to introduce the plating bath or a container accommodating the plating bath in a vessel equipped with a mechanism for generating ultrasonic waves to thereby apply ultrasonic waves.

In this embodiment, too, it is desired that the fluorine-contained resin-containing nickel composite plated layer has a thickness of 2.0 $\mu$m or larger.

In this embodiment, the nozzle plate is immersed in the fluorine-contained resin-containing nickel composite plating bath and, then, ultrasonic waves are applied to the plating bath in order to promote the desorption of bubbles adhered near the ink blow-out nozzles of the nozzle plate and to promote the infiltration of the fluorine-contained resin-containing nickel composite plating solution into the ink blow-out holes. As a result, the interiors of the ink blow-out holes in the nozzle plate are coated with the fluorine-contained resin-containing nickel composite plating up to a predetermined boundary position between the water-repelling region and the hydrophilic region. Thus, there is provided a nozzle plate for the ink-jet head having a clearly defined boundary position between the water-repelling region and the hydrophilic region in the ink blow-out holes. This will be described in further detail in the following embodiments.

In a fourth embodiment of the present invention, the fluorine-contained resin-containing nickel composite plating is applied as a water-repelling coating onto the nozzle plate for the ink-jet head, the nozzle plate comprising a flat plate member having an ink blow-out surface on one surface thereof and having ink blow-out nozzles (ink blow-out holes) formed penetrating through the flat plate member at predetermined positions for blowing out the ink. Here, it is desired that the step of applying the water-repelling film includes a step for filling the interiors of the ink blow-out holes with the positive-type photosensitive resin and curing the resin in a manner of being applied onto the ink blow-out surface and onto the ink blow-out back surface, a step for shielding a portion of the ink blow-out surface inclusive of the ink blow-out holes with a mask that does not transmit ultraviolet rays and, then, for exposing the ink blow-out surface to ultraviolet rays, a step for developing the positive-type photosensitive resin, a step for applying the fluorine-contained resin-containing nickel composite plating, and a step for removing the positive-type photosensitive resin.

In this embodiment, it is desired that the distance of the positive-type photosensitive resin from the ink blow-out surface after developed is controlled depending upon the intensity of the ultraviolet rays and the exposure time, that the viscosity of the positive-type photosensitive resin is not larger than 100 centipoises, that the thickness of the fluorine-contained resin-containing nickel composite plated layer is not smaller than 2.0 $\mu$m, that after part of the ink blow-out surface inclusive of the ink blow-out holes is shielded by a mask that does not transmit ultraviolet rays, the ink blow-out surface is exposed to ultraviolet rays, and the ink blow-out surface is exposed to ultraviolet rays, and that after the ink blow-out surface is exposed to ultraviolet rays, part of the ink blow-out surface inclusive of the ink blow-out holes is shielded by a mask that does not transmit ultraviolet rays and, then, the ink blow-out surface is exposed to ultraviolet rays.

This embodiment utilizes the fact that when the liquid positive-type photosensitive resin is used, the residue of the positive-type photosensitive resin that could cause a defect to the fluorine-contained resin-containing nickel composite plating concentrates not near the ink blow-out holes but on the outer peripheries of the ink blow-out surface. The reason why the residue of the positive-type photosensitive resin concentrates on the outer peripheries of the ink blow-out surface is because the spin-coating method produces a centrifugal force for applying the positive-type photosensitive resin, and whereby the positive-type photosensitive resin is pulled onto the outer peripheries on the ink blow-out surface so as to be thickly applied thereon. In addition to the step of exposing the ink blow-out surface to the ultraviolet rays to dissolve the positive-type photosensitive resin introduced into the ink blow-out holes up to a predetermined boundary position between the water-repelling region and the hydrophilic region, therefore, part of the ink blow-out surface including the ink blow-out holes but excluding the outer peripheries is shielded with a mask that does not transmit ultraviolet rays, and the outer peripheries of the ink blow-out surface are exposed to ultraviolet rays for extended periods of time to effect the developing in order to completely dissolve and remove the positive-type photosensitive resin from the outer peripheries of the ink blow-out surface. As a result, the boundary position between the water-repelling region and the hydrophilic region is made constant in the ink blow-out holes, and a nozzle plate for the ink-jet head is provided having an ink blow-out surface coated with the fluorine-contained resin-containing nickel composite plating free of defects. This will be described in further detail in the following embodiment.

In a fifth embodiment of the present invention, the fluorine-contained resin eutectoid plating film is applied onto the nozzle plate for the ink-jet head, the nozzle plate comprising a flat plate member having an ink blow-out surface on one surface thereof and having ink blow-out nozzles (ink blow-out holes) formed penetrating through the flat plate member at predetermined positions for blowing out the ink. Here, it is desired that the fluorine-contained resin eutectoid plating film is formed on the surface of the nozzle plate, the surface of the plated film is subjected to the fine surface finishing, and the nozzle plate of which the surface is finely finished is fired at a temperature higher than the melting point of the fluorine-contained resin.

In this embodiment, it is desired that the surface of the plated film is finely finished on the side of the ink blow-out surface only of the nozzle plate.

It is further desired that the fine surface finishing is so conducted that the center average coarseness Ra on the surface of the fluorine-contained resin eutectoid plated film is from 0.02 to 0.1 $\mu$m.

As the fine surface finishing, furthermore, there can be employed such means as mirror surface grinding, superfinishing, honing, lapping and electrolytic polishing. As required, these means may be used in combination.

Though described in other embodiments, it is desired that the fluorine-contained resin eutectoid plated film is formed on the surface of the nozzle plate on the side of the ink blow-out surface and in the ink blow-out holes.

In this embodiment, the fluorine-contained resin eutectoid plated film is formed on the surface of the nozzle plate and is, then, subjected to the fine surface finishing. By subjecting the fluorine-contained resin eutectoid plated film to the fine surface finishing, the surface of the plated film is made rough to a suitable degree to exhibit excellent durability against the wiping. That is, the fluorine-contained resin is worn out by the operation for wiping the nozzle plate. However, the fluorine-contained resin that is abraded moves into and stays in the recessed portions. The fluorine-contained resin that has moved into the recessed portions is protected by the metal matrix of the protruded portions, and is not worn out despite of the wiping operation. As a result, the water-repelling property that stems from the fluorine-contained resin on the surface of the nozzle plate is maintained for extended periods of time. Besides, since the fluorine-contained resin eutectoid plated film after the fine surface finishing is heat-treated at a temperature higher than the melting point of the fluorine-contained resin, the fluorine-contained resin partly elutes out on the surface of the film to exhibit its effect more conspicuously as described earlier.

In this embodiment, the ink-jet head incorporating the nozzle plate of the present invention can be constituted as shown in FIG. 1 as described earlier. Therefore, its details are not described here.

Figure 18:
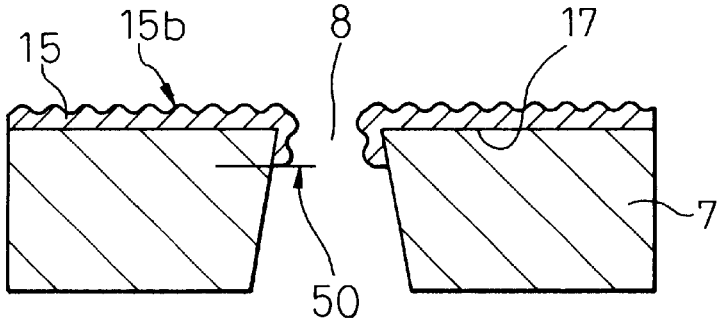
FIG. 18 is a sectional view of the nozzle plate according to a further preferred embodiment of the present invention.
Figure 23:
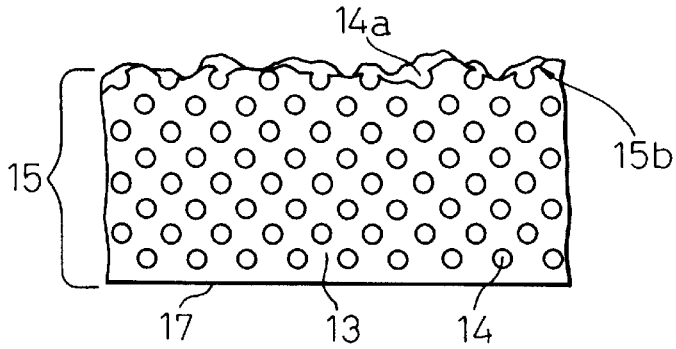
FIG. 23 is a sectional view illustrating, on an enlarged scale, the state near the surface of the film plated on the nozzle plate shown in FIG. 18.

FIG. 18 illustrates a preferred embodiment of the nozzle plate for the ink-jet head of the present invention. The nozzle plate 7 has the fluorine-contained resin eutectoid plated film 15 formed on the ink blow-out surface 17 of the substrate thereof and up to the boundary 50 in the ink blow-out holes 8. The surface 15*b* of the fluorine-contained resin eutectoid plated film 15 is finely finished. As will be understood from FIG. 23 illustrating, on an enlarged scale, a portion near the surface 15*b* of the nozzle plate 7, furthermore, the fluorine-contained resin eutectoid plated film 15 comprises a metal matrix 13 and the fluorine-contained resin 14 incorporated therein, the fluorine-contained resin melted through the heat-treatment spreading on the surface 15*b* after the fine surface finishing (see fluorine-contained resin designated at 14*a*).

According to the present invention, the nozzle plate shown in FIG. 18 can be advantageously produced through the steps shown in series in FIGS. 19 to 22.

Figure 19:
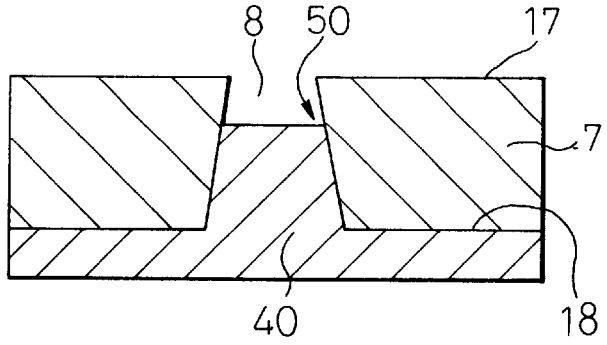
FIGS. 19 to 22 are sectional views illustrating the preferred steps for producing the nozzle plate shown in FIG. 18.
Figure 20:
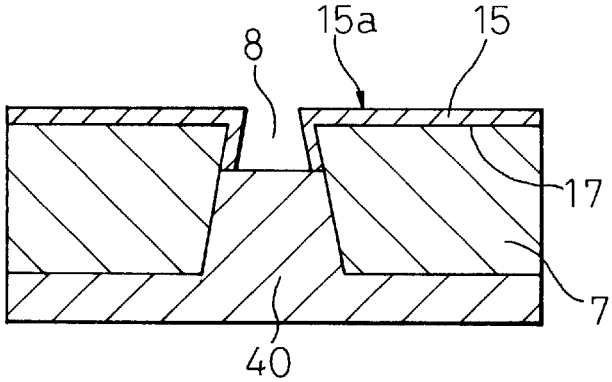
Figure 21:
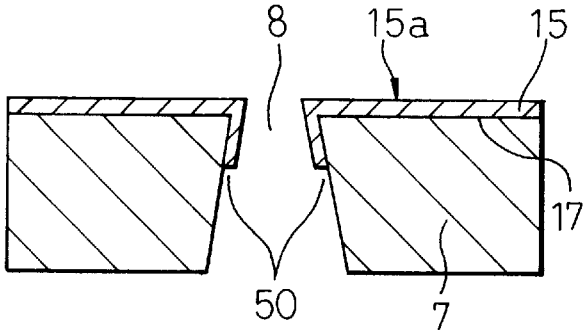
Figure 22:
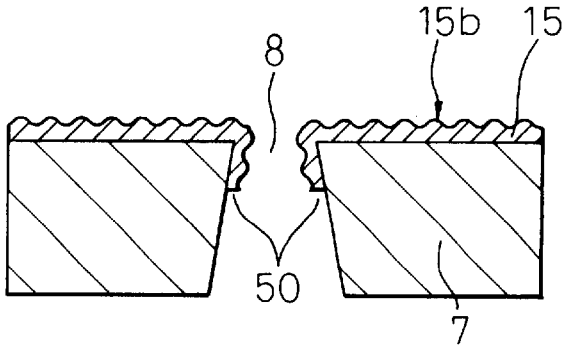
Figure 24:
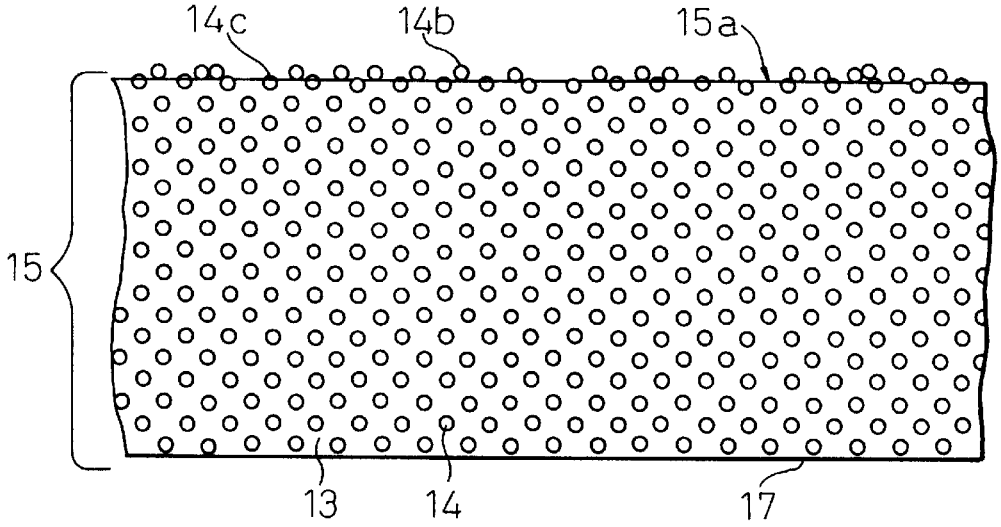
FIG. 24 is a sectional view illustrating, on an enlarged scale, the state near the surface of the film plated on the nozzle plate shown in FIG. 20.
Figure 25:
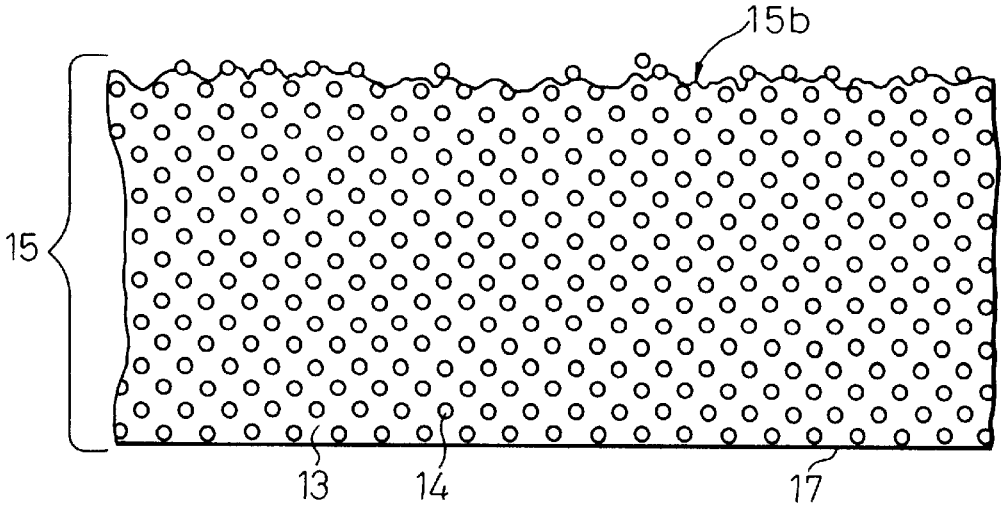
FIG. 25 is a sectional view illustrating, on an enlarged scale, the state near the surface of the film plated on the nozzle plate shown in FIG. 22.

Referring, first, to FIG. 19, the ink blow-out back surface 18 of the nozzle plate 7 is coated with a filler 40 which is introduced halfway into the interiors of the ink blow-out holes 8. Referring, next, to FIG. 20, the plating is effected in a state where the filler 40 is existing in order to form the fluorine-contained resin eutectoid plated film 15 on the ink blow-out surface 17 of the nozzle 7 and inside the ink blow-out holes 8. FIG. 24 illustrates a state near the surface 15*a* of the fluorine-contained resin eutectoid plated layer 15. As shown, the fluorine-contained resin eutectoid plated film 15 contains fluorine-contained resin 14 incorporated in the metal matrix 13, fluorine-contained resin 14*b* simply adhered on the surface, and fluorine-contained resin 14*c* incorporated in the metal matrix 13 and is exposed on the surface. When the filler 40 that is no longer necessary after the completion of the plating is removed from the nozzle plate 7, the fluorine-contained resin eutectoid plated film 15 remains applied onto the ink blow-out surface 17 of the nozzle plate 7 and onto the interiors of the ink blow-out holes 8 as shown in FIG. 21. When the surface 15*a* of the fluorine-contained resin eutectoid plated film 15 on the nozzle plate 7 is finely finished in this state, the surface of the fluorine-contained resin eutectoid plated film 15 changes from the surface 15*a* into the surface 15*b* as shown in FIG. 22. FIG. 25 is a sectional view illustrating a portion near the surface of the fluorine-contained resin eutectoid plated film 15. As shown, the metal matrix 13 has the surface 15*b* that is finely finished. Thereafter, the plated film is heat-treated at a temperature higher than the melting point of the fluorine-contained resin to obtain the nozzle plate 7 shown in FIGS. 18 and 23. In the diagramed steps of production, the nozzle plate 7 of the present invention can be produced even when the fine surface finishing shown in FIG. 22 is executed after the step of the fluorine-contained resin eutectoid plating shown in FIG. 20 and, then, the treatment is effected for removing the filler shown in FIG. 21.

Described below next are the materials and methods used for the embodiment.

As described in the foregoing embodiments, the nozzle plate may be a nickel plate obtained by the electroforming method, a stainless steel plate having ink blow-out holes formed by plastic working, or a plastic material, ceramic or silicon obtained by the injection-molding. In this embodiment, furthermore, it is desired that the surface of the nozzle substrate has been smoothed in order to control the surface roughness by the subsequent fine surface finishing. Even when the nozzle substrate has a rough surface, the film may be thickly plated and the surface may be made uniform by fine surface finishing.

The filler used as the masking means may be a photosensitive resin film, a liquid photosensitive resist material, or any other resin material provided it exhibits resistance against the fluorine-contained resin eutectoid plating solution and the chemicals of before the fluorine-contained resin eutectoid plating is effected. These materials, too, have been described already as masking means in the foregoing embodiments.

The step of fluorine-contained resin eutectoid plating can be executed in the same manner as in the above-mentioned embodiment. For instance, the surface of the nozzle substrate is activated by using an aqueous solution of hydrochloric acid, nickel is strike-plated by using an aqueous solution of nickel chloride, the nozzle plate is washed with pure water and, then, the fluorine-contained resin eutectoid plating is effected. The thickness of the fluorine-contained resin eutectoid plated film can be selected depending on the required nozzle diameter. In order to cover the surface with the fluorine-contained resin to a sufficient degree after the firing, however, it is desired that the thickness is not smaller than 2 $\mu$m and, preferably, not smaller than 3 $\mu$m. When the surface of the nozzle substrate has been contaminated before the activation treatment, a treatment may be employed such as oxygen plasma treatment or UV ozone treatment for removing organic matters. The activation treatment is not limited to the one that uses hydrochloric acid, and acids such as sulfuric acid, phosphoric acid and hydrofluoric acid may be suitably selected and used being mixed together. The fluorine-contained resin eutectoid plated film can be represented by a film in which fine particles of PTFE having an average particle diameter of about 0.3 $\mu$m are dispersed in the nickel matrix. Here, however, the metal that serves as a matrix may be suitably selected from copper, silver, zinc or tin in addition to nickel, or may be suitably selected from a nickel-phosphorus alloy, nickel-boron alloy or nickel-cobalt alloy. The plating method may be an electric plating or a non-electrolytic plating. As the fluorine-contained resin, there can be used a high-molecular compound such as PTFE, PFA, polyfluorovinylidene or polyfluorovinyl, a copolymer of plural kinds of fluorine-contained monomers, or a copolymer of a fluorine-contained monomer and a non-fluorine type monomer, in a single kind or being mixed together.

In the step of removing the filler, a peeling solution is selected that does not affect the nozzle plate or the fluorine-contained resin eutectoid plated film. Or, some filler can be removed in the step of heat-treatment.

In the step of fine surface finishing, there may be suitably selected and used the mirror surface grinding, superfinishing, honing, lapping or electrolytic polishing. It is desired that the surface roughness Ra after the fine surface finishing is from 0.02 to 0.1 μm. The fine surface finishing employed in the present invention is the one that is usually used as the fine finishing, and is not affected by a change in the surface roughness Ra in the surface of before the fine surface finishing or in the surface of after the fine surface finishing. The surface of the fluorine-contained resin eutectoid plated film could be a very smooth surface or a rough surface being affected by the surface condition of the nozzle substrate of before being applied with the fluorine-contained resin eutectoid plating and affected by the fluorine-contained resin eutectoid plating conditions. Therefore, the surface roughness Ra may become large or small depending upon ordinary fine surface finishing. For example, the surface of the nozzle substrate before being subjected to the fine surface finishing is, in many cases, finished to a mirror surface of Ra of about 0.01 μm so that maintenance such as wiping can be smoothly conducted. When the fluorine-contained resin eutectoid plated film is formed maintaining a thickness of about 2 to about 3 μm on the nozzle substrate having a mirror surface, the surface becomes very smooth having a roughness Ra of from 0.01 to 0.02 μm. In this case, the surface is roughened by lapping or the like to Ra of 0.05 μm, which still corresponds to the fine surface finishing of after the fluorine-contained resin eutectoid plating of the present invention. The surface roughness Ra according to the present invention can be measured by a probe-type surface roughness meter that is widely used.

In the heat-treatment of the fluorine-contained resin, the temperature of the heat-treatment must be set with regard to the melting point which differs depending upon the kind of the fluorine-contained resin, and attention must be paid to keeping the temperature lower than the thermal decomposition temperature. When there occurs a difference in the properties due to the degree of crystallization after cooling, attention is better given to the cooling temperature and the cooling method. When TPFE is used as a representative fluorine-contained resin, the degree of crystallization differs depending upon the rate of cooling. In general, the degree of crystallization becomes low when the resin is quickly quenched, and excellent durability is exhibited. For this purpose, it is desired to the air rather than to just leave the resin in the air to cool it. Cooling the resin by immersing it in a medium such as water is even more effective.

This will be described in further detail in the following embodiment.

In a sixth embodiment of the present invention, the nozzle plate for the ink-jet head comprises a flat plate member having the ink blow-out surface on one surface thereof and having ink blow-out holes penetrating through the flat plate member at predetermined positions for blowing the ink, and being coated with the water-repelling film on the ink blow-out surface thereof and in the ink blow-out holes thereof. Here, it is desired that the ink blow-out surface of the nozzle plate is formed rough. It is desired that the roughness in the ink blow-out surface has a height of at least 0.01 μm and is smaller than the thickness of the water-repelling film.

As in the above-mentioned embodiment, the water-repelling film is preferably a fluorine-contained resin-containing nickel composite plated film having a thickness of, desirably, at least not smaller than 2.0 μm.

In producing the nozzle plate for the ink-jet head according to this embodiment, it is desired that the water-repelling film is formed after a predetermined roughness is formed in the ink blow-out surface of the nozzle plate. In the thus formed water-repelling film, the height of roughness in the ink blow-out surface is preferably 0.01 μm and is smaller than the thickness of the water-repelling film. Similarly, it is desired that the water-repelling film is a fluorine-contained resin-containing nickel composite plated film having a thickness of at least not smaller than 2.0 μm.

In this embodiment, it is desired that roughness is formed in the ink blow-out surface of the nozzle plate as described above. This is based on the knowledge of the present inventors as described below.

In order for the ink blow-out surface of the nozzle plate to exhibit water-repelling property, it is necessary to apply a material having a small surface energy onto the ink blow-out surface by the coating method or the like method. The fluorine-contained resin and the silicone resin are the materials best suited for this purpose. When the ink blow-out surface is smooth, however, the blade made of an elastic rubbery material that is used for effecting the wiping operation comes into contact with the whole ink blow-out surface creating a large frictional resistance. Therefore, the resin material which, usually, has a low hardness is gradually worn out and is, finally, completely peeled off and is lost. Concerning this point, the present inventors have conducted a keen study. That is, the inventors have formed roughness in the ink blow-out surface and have formed a water-repelling film thereon thereby to transfer roughness onto the water-repelling film, the roughness having height which is the same as that in the ink blow-out surface. As a result, the inventors have found that the contact area with the blade decreases during the wiping operation and, particularly, the recessed portions are maintained away from the blade, that despite the water-repelling film at the protruded portions being worn out being wiped by the blade, the film is partly deposited in the recessed portions and remains to maintain the water-repelling property on the ink blow-out surface, and that when a fluorine-contained resin-containing nickel composite plated film is used as the water-repelling film in which nickel or a nickel alloy having hardness larger than that of the resin is serving as a matrix, there is obtained durability superior to that of the water-repelling film which comprises the fluorine-contained resin or the silicone resin alone.

In a seventh embodiment of the present invention, it is desired that the nozzle plate for the ink-jet head has portions where the fluorine-contained resin eutectoid plated film is formed and portions where this film is not formed in the ink blow-out surface of the flat plate member having ink blow-out holes penetrating through up to the ink blow-out surface, that the ink blow-out holes on the side of the ink blow-out surface are included in the portions where the fluorine-contained resin eutectoid plated layer is formed, and that the fluorine-contained resin eutectoid plated layer inclusive of the ink blow-out holes is continuing up to the interiors of the ink blow-out holes.

In the nozzle plate for the ink-jet head according to this embodiment, it is desired that the region occupying the ink blow-out holes in the ink blow-out surface and the peripheries of the ink blow-out holes is lower than the region surrounding the peripheries of the ink blow-out holes (i.e., a step exists between these two regions), and the fluorine-contained resin eutectic plated film including the ink blow-out holes is formed to include the walls at the step.

In this embodiment, it is further desired that the nozzle plate has a plurality of ink blow-out holes, the portion where the fluorine-contained resin eutectoid plated film is formed inclusive of the ink blow-out holes, comprises a pattern including a single or a plurality of ink blow-out holes, the pattern being formed in a number of one or in a plural number.

The nozzle plate for the ink-jet head according to this embodiment will be further described with reference to the drawings. The ink-jet head using the nozzle plate can be constituted, for example, in a manner as described above with reference to FIG. 1 and is not, hence, described here in detail.

Figure 38:
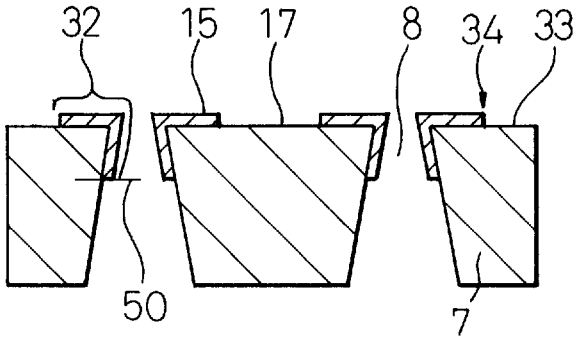
FIG. 38 is a sectional view illustrating the nozzle plate according to a yet further preferred embodiment of the present invention.

FIG. 38 is a sectional view of a plane perpendicular to the ink blow-out surface of the nozzle plate. The nozzle plate 7 has the fluorine-contained resin eutectoid plated film 15 which includes the ink blow-out holes 8 on the side of the ink blow-out surface 17 of the nozzle plate 7, the end of the plated film 15 extending up to the boundary 50 halfway into the interiors of the ink blow-out holes 8. In this specification, the region where the fluorine-contained resin eutectoid plated film 15 is formed is denoted by a reference numeral 32. The nozzle plate 7 may be a nickel plate obtained by the electroforming method, a stainless steel having ink blow-out holes formed by the plastic working, or may be made of a plastic material, ceramic or silicon molded by an injection-molding method. The fluorine-contained resin eutectoid plated film 15 is represented by a film in which fine particles of PTFE having an average particle diameter of about 0.3 $\mu$m are dispersed in the nickel matrix. The metal serving as the matrix may be suitably selected from copper, silver, zinc or tin in addition to nickel and may further be suitably selected from a nickel-phosphorus alloy, a nickel-boron alloy or a nickel-cobalt alloy. The plating method may be either electrolytic plating or non-electrolytic plating. The fluorine-contained resin may be a high-molecular compound such as PTFE, PFA, polyfluorovinylidene or polyfluorovinyl, a copolymer of a plural kinds of fluorine-contained monomers, or a copolymer of a fluorine-contained monomer and a non-fluorine-type monomer, which may be used in a single kind or in combination.

With the nozzle plate 7 being constituted as described above, the ink droplets adhered onto the fluorine-contained resin eutectoid plated film 15 on the side of the ink blow-out surface 17, smoothly migrate from the region 32 where the water-repelling fluorine-contained resin eutectoid plated film 15 is formed onto the outer region 33 where the fluorine-contained resin eutectoid plated film 15 is not formed upon effecting the maintenance operation such as wiping. Near the boundary 34 between the fluorine-contained resin eutectoid plated film 15 and the region 33 where the plated film is not formed, in particular, the ink droplets are attracted by the portion 33 where the plated film is not formed, and the ink droplets are efficiently removed from the peripheries of the ink blow-out holes 8. In order that the ink droplets are smoothly migrated, the surface of the portion 33 where the film is not plated should exhibit a hydrophilic property. For this purpose, the nozzle plate 7 should be made of a metal material or should be plated with a metal film when other material is used. Though not shown in FIG. 38, there may exist a region where the fluorine-contained resin eutectoid plated film is formed without including the ink blow-out holes on the side of the ink blow-out surface 17 in order to control the removal of ink and the direction of migration of the ink at the time of wiping the ink.

Figure 49:
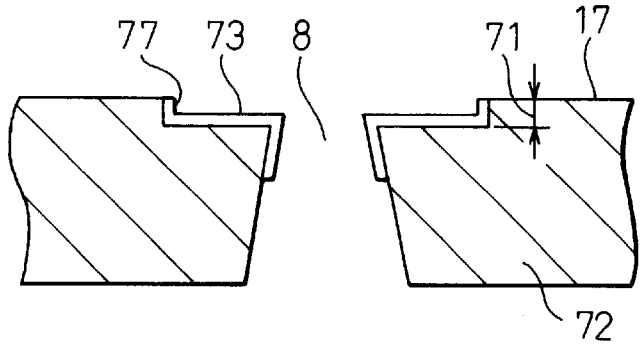
FIG. 49 is a sectional view illustrating the nozzle plate according to another preferred embodiment of the present invention.
Figure 50:
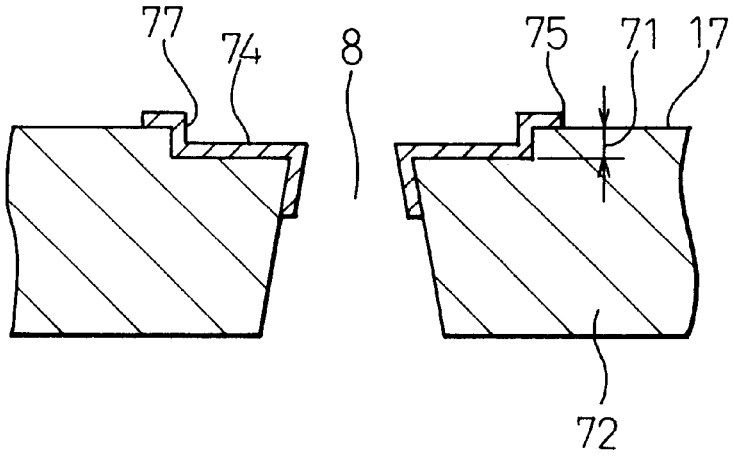
FIG. 50 is a sectional view illustrating the nozzle plate according to a further preferred embodiment of the present invention.

In this embodiment, the nozzle substrate has a stepped ink blow-out surface in which the region occupying the ink blow-out holes and the peripheries of the ink blow-out holes is lower than the outer peripheries of the ink blow-out holes. This stepped structure makes it possible to obtain a nozzle plate having excellent durability. The ink droplets easily adhere on the vicinities of the ink blow-out holes on the ink blow-out surface of the nozzle plate. Therefore, a step in the ink blow-out surface of the nozzle plate helps decrease the friction caused by the blade that comes in contact with the fluorine-contained resin eutectoid plated film in the peripheries of the ink blow-out holes during the wiping operation. This prevents the fluorine-contained resin eutectoid plated film from being worn out in the vicinities of the ink blow-out holes, and helps improve reliability of the ink-jet recording head for extended periods of time. FIGS. 49 and 50 are sectional views illustrating typical examples of the nozzle plate having a stepped ink blow-out surface.

The nozzle plate 72 shown in FIG. 49 has a step 71 on the side of the ink blow-out surface 17 for lowering the peripheries of the ink blow-out holes 8 compared to the surrounding of the ink blow-out holes 8, and wherein the fluorine-contained resin eutectoid plated film 73 is so patterned as to include the wall 77 of the step 71 and to extend into the interiors of the ink blow-out holes 8. When the step 71 is too small, the above-mentioned effect is not exhibited to a sufficient degree. When the step 71 is too large, it becomes difficult to remove the ink. It is therefore desired that the step 71 is from 1 to 10 $\mu$m. In the nozzle plate 72 shown in FIG. 50, the fluorine-contained resin eutectoid plated film 74 includes from the surrounding 75 of the step 71 in the ink blow-out surface 17 to the wall 77 of the step 71, and is so patterned as to extend up to the interiors of the ink blow-out holes 8. Depending on the wiping conditions and the ink that is used, the nozzle plate 72 and the pattern of the fluorine-contained resin eutectoid plating film 74 may be suitably changed, selected or combined.

Described below next is a pattern of the fluorine-contained resin eutectoid plated film when the nozzle plate 7 is viewed from the side of the ink blow-out surface 17. In this embodiment, the optimum pattern of the fluorine-contained resin eutectoid plated film on the side of the ink blow-out surface 17 differs depending upon the arrangement of the ink blow-out holes in the nozzle plate, kind of the ink that is used and the wiping conditions. Therefore, the region for forming the fluorine-contained resin eutectoid plated film is particularly constituted as described above and, besides, the pattern of the fluorine-contained resin eutectoid plated film on the side of the ink blow-out surface 17 is optimized, in order to efficiently remove the ink during the wiping operation.

Figure 44:
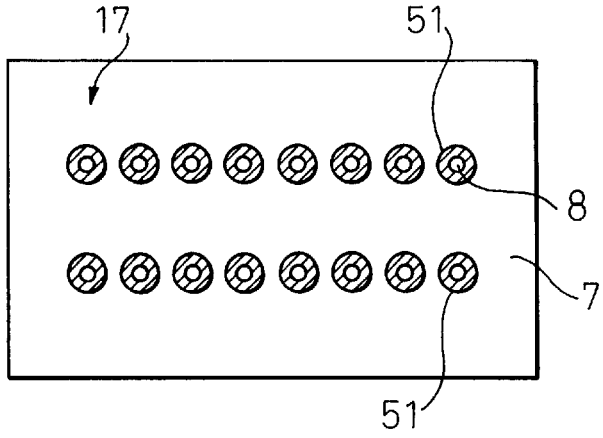
FIGS. 44 to 48 are plan views illustrating the patterns of the fluorine-contained resin-containing composite plating on the nozzle plate according to the present invention.
Figure 45:
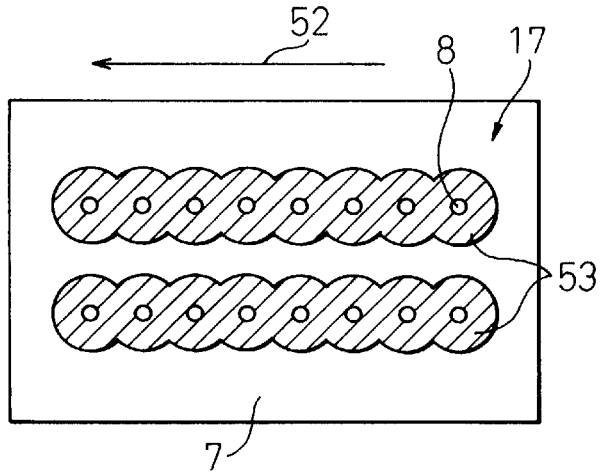
Figure 46:
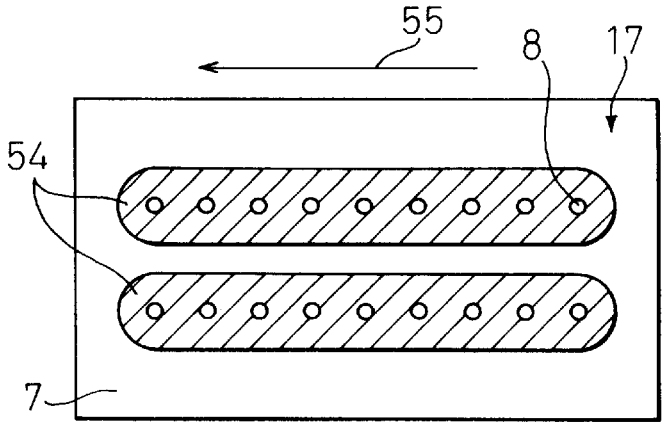
Figure 47:
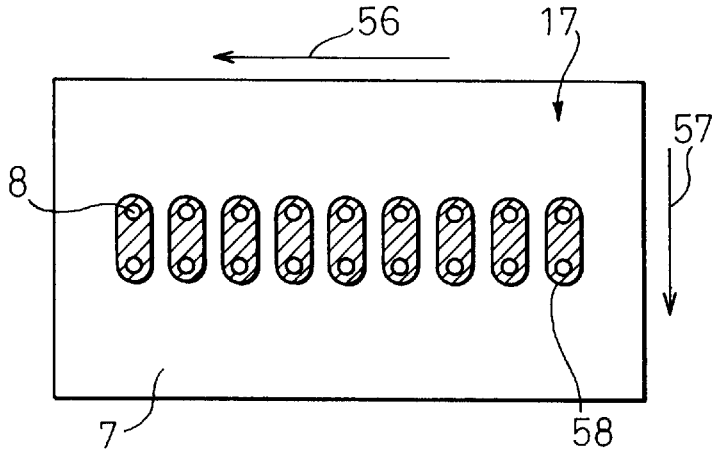
Figure 48:
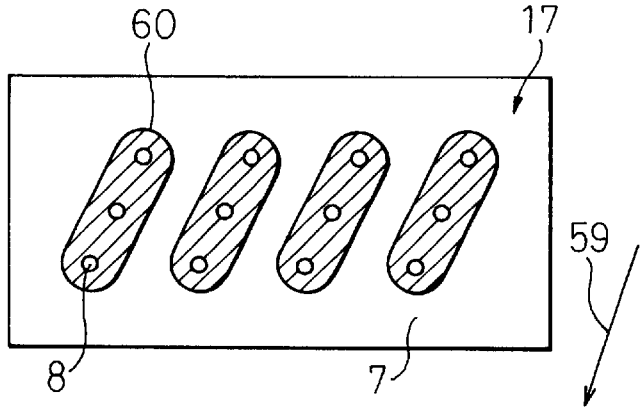

Referring, first, to FIG. 44, a plurality of ink blow-out holes 8 are formed in the nozzle plate 7 on the side of the ink blow-out surface 17, and are surrounded by the fluorine-contained resin eutectoid plated film as represented by patterns 51. Each pattern 51 of the fluorine-contained resin eutectoid plated film is represented by a circle with the ink blow-out hole 8 as a center. The pattern 51, however, may be suitably selected from an ellipse, a polygon or a shape formed by chamfering the polygon. FIG. 45 illustrates a pattern 53 of the fluorine-contained resin eutectoid plated film that includes the ink blow-out holes 8 and is continuing in the transverse direction 52 of the ink blow-out holes 8. FIG. 46 illustrates a pattern 54 of the fluorine-contained resin eutectoid plated film that includes the ink blow-out holes 8 and is continuing in the transverse direction 55 of the ink blow-out holes 8, but has a shape different from that of FIG. 45. FIG. 47 illustrates patterns 58 of the fluorine-contained resin eutectoid plated films formed in a plural number, which are not continuing in the transverse direction 56 of the ink blow-out holes 8 but are neighboring in the direction of an arrow 57. FIG. 48 illustrates patterns 60 of the fluorine-contained resin eutectoid plated films which are continuing in an inclined direction 59 so as to cover a plurality of ink blow-out holes 8. The above-mentioned patterns of the fluorine-contained resin eutectoid plated films need not exist as a repetition of the same pattern in a piece of the nozzle plate but may exist in a combination of various patterns depending upon the maintenance conditions.

EXAMPLES

The invention will now be concretely described with reference to Examples. It should, however, be noted that the invention is in no way limited to these Examples only.

Example 1

Figure 5:
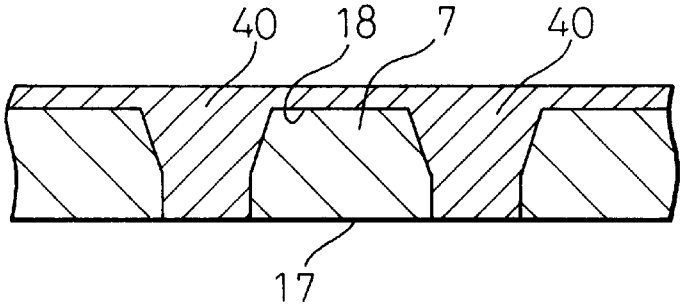
FIG. 5 is a sectional view illustrating preferred steps for producing the nozzle plate shown in FIG. 4.
Figure 5:
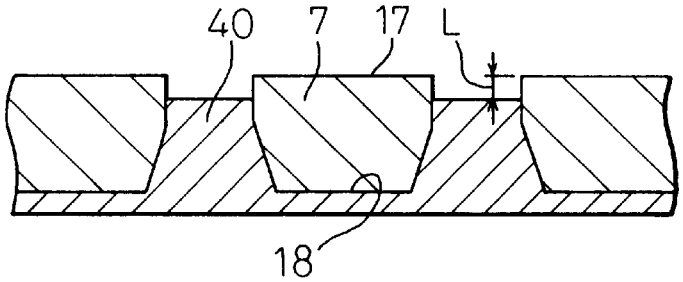
Figure 5:
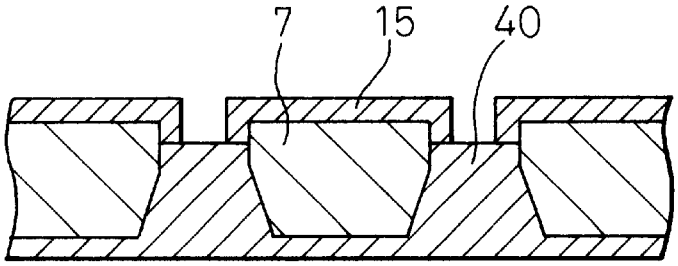

The nozzle plate shown in FIG. 4 was prepared through the steps shown in series in FIG. 5.

First, a positive-type resist material was introduced and applied onto the nozzle plate of nickel containing nozzles formed by the electroforming method as shown in FIG. 5(A). Then, the resist material was selectively removed to form a boundary as shown in FIG. 5(B). Thereafter, the surface of the nozzle plate on which the electric field eutectoid plating is to be applied, was treated with an oxygen plasma to remove adhered matters such as organic matters from the surface. After the surface has been cleaned, the plating surface of the nozzle plate was activated by using an aqueous solution of hydrochloric acid. The nozzle plate was immersed in a solution of nickel chloride maintained at room temperature, and the strike-plating was effected at a current density of 6 A/dm$^2$ for 2 minutes. After washed with pure water, the nozzle plate was immersed in an electrolytic eutectoid plating solution maintained at 42° C. (available as "Metaflon FS" (trade name) from Kamimura Kogyo Co.), and on which the eutectoid plating was effected at a current density of 2 A/dm$^2$ for a predetermined period of time. The fluorine-contained resin in the electrolytic eutectoid plating solution used here was PTFE having a melting point of 327° C. There was obtained a nozzle plate provided with a eutectoid plating layer having a predetermined thickness. Thereafter, the resist layer for forming the boundary was removed by using a peeling solution in order to obtain a nozzle plate having a boundary between the ink-repelling region/ink-compatible region as shown in FIG. 4. The obtained nozzle plate was washed with pure water to a sufficient degree, and was dried with the hot air to vaporize the water content. Then, the nozzle plate was fired at a temperature of 330° C. for 1 hour. There was obtained a desired nozzle plate having an ink-repelling layer of a thickness of 2.1 $\mu$m.

[Evaluation Testing]

By using the thus obtained nozzle plate, an ink-jet head having constitution as shown in FIG. 1 was fabricated and was evaluated.

(1) Measurement of the Resistance Against the Positive Pressure.

An ink was introduced into the ink-jet head to measure the resistance against the positive pressure of the ink, that serves as a scale of the ink-repelling property around the nozzles. Here, the "resistance against the positive pressure" is a scale representing whether the ink leaks from the nozzle when a predetermined pressure is applied after the ink was poured into the head of the structure shown in FIG. 1 using the nozzle plate provided with the ink-repelling layer. Concerning the resistance against the positive pressure, the present inventors judge, based on the experience, that the nozzle plate exhibits good resistance against the positive pressure when the ink leaks through the nozzle upon the application of a pressure of not smaller than 20 mb. In the measurement of the resistance against the positive pressure, the pressure of 21 mb was exhibited proving that the nozzle plate possessed good resistance against the positive pressure.

(2) Relationship Between the Plating Time and the Plating Thickness.

Figure 7:
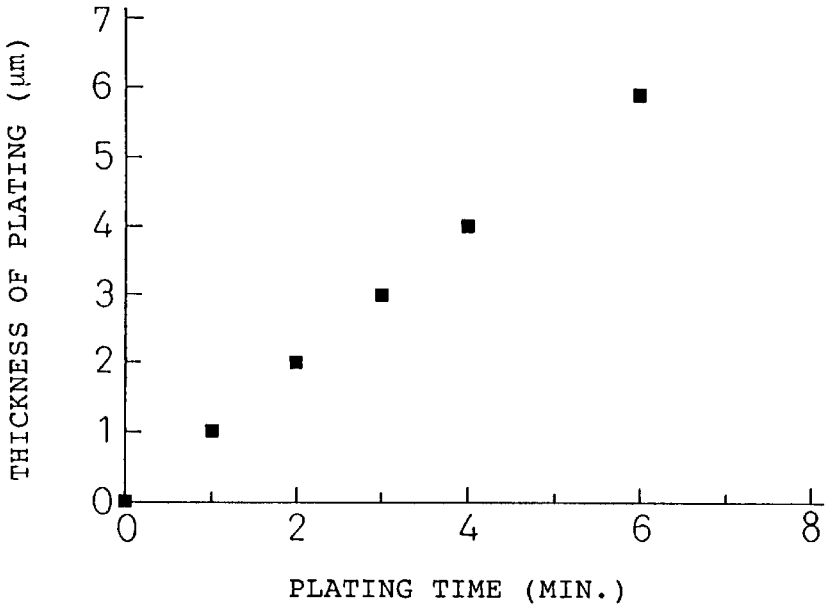
FIG. 7 is a graph illustrating a relationship between the plating time and the thickness of plating in forming the fluorine-contained resin-containing composite plating.

In this Example, the eutectoid plating was applied onto the nozzle plate. In this case, the thickness of the plating, i.e., the thickness of the ink-repelling layer can be controlled by adjusting the time for the eutectoid plating. Therefore, the time for the eutectoid plating was changed to examine the relationship between the eutectoid plating time and the thickness of the ink-repelling layer. The obtained results were plotted as shown in a graph of FIG. 7. The rate of forming the ink-repelling layer varies depending on the kind of the eutectoid plating solution. Therefore, the rate of forming the ink-repelling layer must be measured for every change in the eutectoid plating solution.

(3) Relationship Between the Thickness of the Plating and the Resistance Against the Positive Pressure.

Figure 8:
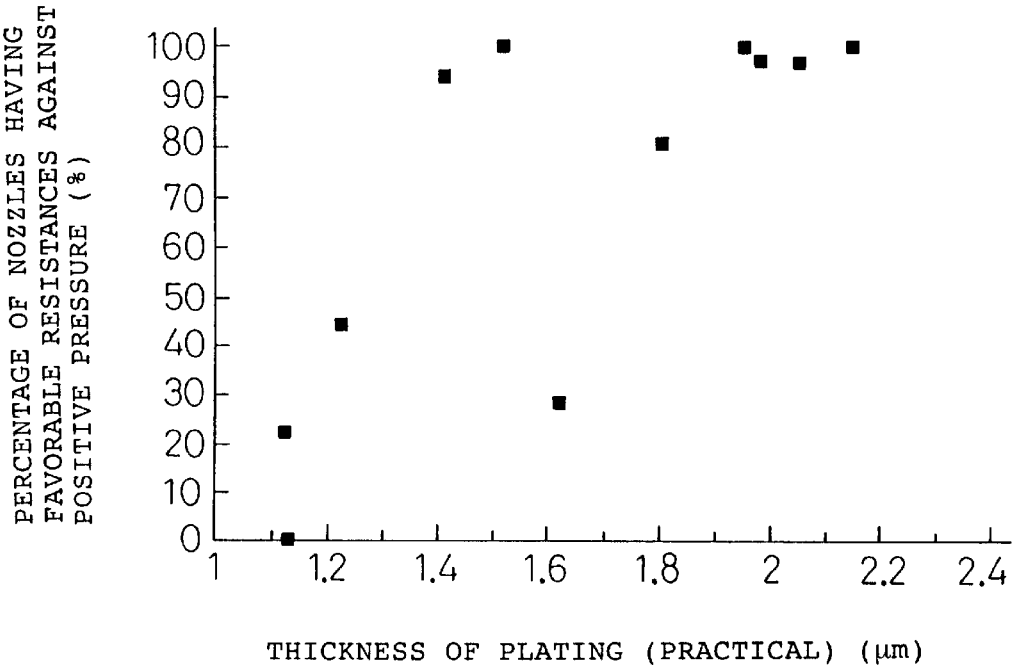
FIG. 8 is a graph illustrating a relationship between the thickness of plating and the resistance against the positive pressure in forming the fluorine-contained resin-containing composite plating.

In this Example, it was examined how the resistance against the positive pressure changes depending upon the thickness of the eutectoid plating. A correlation between the thickness of the plated film and the resistance against the positive pressure that serves as a scale of the ink-repelling property around the nozzle holes, was measured while changing the thickness of the ink-repelling layer of the nozzle plate, and was plotted as shown in a graph of FIG. 8.

As in the above-mentioned measurement of the resistance against the positive pressure, the resistance against the positive pressure of the nozzle plate was judged to be favorable when the ink leaked through the nozzle holes upon the application of a pressure of not smaller than 20 mb. As will be obvious from FIG. 8, the nozzle plate having a favorable resistance against the positive pressure was obtained when the thickness of the plated film was not smaller than 2.0 $\mu$m, i.e., when the thickness of the ink-repelling layer was not smaller than 2.0 $\mu$m.

For the purpose of comparison, an ink-jet head having an ink-repelling layer of a thickness of smaller than 2.0 $\mu$m was fabricated in the same manner as the ink-jet head of this Example, and was measured for its resistance against the positive pressure in a manner as described above. As will be obvious from FIG. 8, when the thickness of the ink-repelling layer was smaller than 2.0 $\mu$m, there were obtained only nozzle plates having unstable resistance against the positive pressure. This is presumably because the amount of the fluorine-contained resin (PTFE) is small in the eutectoid plated layer, and the peripheries of the nozzles and the surface of the nozzle plate are covered with decreased amounts of the cord-like fluorine-contained resin.

Example 2

The procedure described in Example 1 was repeated. In this Example, however, the boundary was formed on the nickel nozzle plate obtained by the electroforming method by using the positive-type resist material, the strike-plating was effected and, then, the electrolytic eutectoid plating was applied thereon maintaining a thickness of 2.0 $\mu$m. The processing was conducted in the same manner as in the above-mentioned Example 1 to peel the resist off. The obtained nozzle plate was washed well with pure water and was dried with the hot air to vaporize the water. The nozzle plate was further fired at 350° C. for 1 hour to prepare a nozzle plate having an ink-repelling layer.

In this Example, the obtained nozzle plate was fired at 350° C. as described above. The fluorine-contained resin used in this embodiment melts at 327° C. This means that the nozzle plate provided with the ink-repelling layer relying on the fluorine-contained resin eutectoid plating was fired at a temperature higher than the melting point of the fluorine-contained resin by more than 20° C. Accordingly, there were obtained the results more favorable than those of the case of the above-mentioned Example 1. In the above-mentioned Example 1, the nozzle plate exhibited resistance against the positive pressure of up to 20 mb leaving, however, some problem concerning the smoothness of the surface due to the presence of mass of PTFE on the surface of the nozzle plate. In this Example, on the other hand, there was no mass of PTFE on the surface of the nozzle plate and there was no problem concerning the smoothness on the surface.

In the step of firing the nozzle plate provided with the ink-repelling layer, it is necessary that the firing temperature is not lower than the melting point of the fluorine-contained resin. It is not, however, desired that the firing temperature is much higher than the melting point of the fluorine-contained resin.

According to the nozzle plate for the ink-jet head and the method of its production of the present invention as will be understood from the results of the above-mentioned Examples 1 and 2, the fluorine-contained resin eutectoid plating is applied as an ink-repelling layer onto the peripheries of the nozzles and onto the surface of the nozzle plate maintaining a thickness of not smaller than 2.0 μm and, preferably, not smaller than 3.0 μm, making it possible to provide an ink-jet head having excellent resistance against the positive pressure, without permitting the ink to stay adhered around the ink blow-out holes after the ink was blown out, permitting the ink droplets to be stably blown out straight, maintaining the reliable printing quality not only in the early time but for extended periods of time.

Example 3

In this Example, a nozzle plate generally shown in FIG. 2 and partly shown on an enlarged scale in cross section in FIG. 4, was prepared through the steps shown in series in FIG. 5. The nozzle plate 7 has the fluorine-contained resin-containing nickel composite plating 15 as an ink-repelling layer covering the ink blow-out surface 17, the fluorine-contained resin-containing nickel composite plating 15 partly entering into the interiors of the ink blow-out holes 8. Owing to this constitution, a boundary 50 between the water-repelling region and the hydrophilic region was formed in the ink blow-out holes 8, stabilizing the position of meniscus at the time of blowing out the ink.

First, the photosensitive resin film was introduced in the ink blow-out holes in the nozzle plate having a length of 20 mm, a width of 15 mm, a thickness of 0.1 mm and having many circular ink blow-out holes penetrating through therein, from the side of the ink blow-out back surface, up to a predetermined position where the boundary between the water-repelling region and the hydrophilic region was to be located. The photosensitive resin was then cured. Here, in order that the photosensitive resin film was introduced up to the boundary between the water-repelling region and the hydrophilic region, and was cured, the photosensitive resin film was brought into pressed contact with the ink blow-out back surface and was partly introduced up to the predetermined position in the ink blow-out holes while controlling the viscosity by the temperature, and was irradiated with ultraviolet rays. In this Example, the boundary between the water-repelling region and the hydrophilic region was set to be 10 μm deep from the ink blow-out surface of the nozzle plate.

The nozzle plate used here was a nickel plate produced by the electroforming method. It is, however, also allowable to obtain comparable results even by using the nozzle plate made of another material, such as a stainless steel plate having ink blow-out holes formed by the plastic working, or a plastic material, a ceramic or silicon obtained by the injection-molding method.

The ink blow-out holes of the nozzle plate will now be described. The nozzle plate has 30 ink blow-out holes arranged in line, the ink blow-out holes being tapered in cross section so that the ink passes smoothly and is blown out straight. The ink blow-out holes have a diameter of 35 μm on the side of the ink blow-out surface and a diameter of 50 μm on the side of the ink blow-out back surface.

The photosensitive resin film used in this Example works as a masking means for the fluorine-contained resin-containing nickel composite plating. The masking, however, may be obtained by using other materials or methods. For instance, the liquid photosensitive resist employed in the above-mentioned Example can be advantageously used as the masking means. Or, the resin having resistance against the plating solution and that can be easily removed after plated, may be introduced into the ink blow-out holes 8 up to the boundary 50 between the water-repelling region and the hydrophilic region, and is cured.

After the photosensitive resin film has been cured, a bath containing the fluorine-contained resin-containing nickel composite plating solution of the following composition is established.

| | |
|---|---|
| Nickel sulfamate | 280 g/l |
| Nickel chloride | 30 g/l |
| Boric acid | 40 g/l |
| Polytetrafluoroethylene particles (average particle diameter, 0.3 μm) | 100 g/l |
| Dispersing agent | 0.1 g/l |
| Temperature of the plating solution | 42° C. |

In the above-mentioned plating solution bath was immersed the nozzle plate having the photosensitive resin film introduced through the above-mentioned step up to the boundary between the water-repelling region and the hydrophilic region and was cured therein. In this Example, a piece of nozzle plate was immersed in the plating solution bath. As required, however, two or more nozzle plates may be simultaneously immersed in the plating solution bath. Thereafter, the ultrasonic wave-generating terminal was inserted in the plating solution bath near the ink blow-out holes of the nozzle plate to generate ultrasonic waves. The conditions for generating the ultrasonic waves were as follows:

| Ultrasonic wave-generating terminal | |
|---|---|
| | "SONIFIER 450" (trade name) manufactured by Branson Co. |
| Frequency | 20 KHz |
| Output | level 2 |
| Distance between the wave-generating terminal and the nozzle plate | 5 cm |
| Time for applying ultrasonic waves | 20 seconds |

In this Example, the conditions for generating ultrasonic waves are not limited to the above-mentioned conditions only, but optimum conditions can be found depending upon the volume of the plating bath, distance between the nozzle plate in the plating bath and the ultrasonic wave-generating terminal, and the arrangement thereof. As done in the above-mentioned Example, it is desired that the ultrasonic waves are generated near the ink blow-out holes as much as possible.

After the treatment with the ultrasonic waves has been finished, the ultrasonic waves are no longer generated, and an electric current was supplied under the following conditions to start the electroplating.

| | |
|---|---|
| Temperature of the plating solution | 42° C. |
| Stirring | using a stirring pump |
| Positive electrode | nickel plate |
| Current density of negative electrode | 2 A/dm$^2$ |
| Swinging speed of nozzle plate | 3 m/min. |
| Plating time | 5 min. |

Though not conducted in this Example, the plating may be started by inserting the ultrasonic wave-generating terminal in the plating solution in advance, and applying a current while generating the ultrasonic waves near the ink blow-out holes. Though there is no particular limitation on the time for applying the ultrasonic waves, the application of the ultrasonic waves for an extended period of time causes a great reduction in the eutectoid amount of the fluorine-contained resin in the plated film, or impairs the plating reaction. In order to obtain the effect of the present invention, therefore, the ultrasonic waves are applied for not longer than one minute. It is therefore desired to quickly discontinue the application of ultrasonic waves after the treatment within a predetermined period of time of not longer than one minute. The plating solution is stirred by the pump for preventing the PTFE particles from coagulating or precipitating and, hence, for homogeneously dispersing the PTFE particles in the plating solution. The stirring is not produced by only using the pump but may also be produced by using a stirrer or the like.

Through the above-mentioned series of steps, the fluorine-containing resin-containing nickel composite plating is applied maintaining a thickness of 3 $\mu$m onto the ink blow-out surface and into the interiors of the ink blow-out holes of the nickel nozzle plate. The thickness of the plated film can be controlled relying on the negative electrode current density and the plating time. According to the study by the present inventors, the thickness of the plated film must not be smaller than 2.0 $\mu$m to obtain a desired water-repelling property and must, preferably, be 3 $\mu$m or more.

Next, the photosensitive resin film that has terminated its role as the masking means was removed by dissolution using a solvent. As a result, there was obtained, as shown in FIG. 4, the nozzle plate for the ink-jet head in which the fluorine-contained resin-containing nickel composite plating 15 has entered into the ink blow-out holes 8 to clearly and constantly define the boundary 50 between the water-repelling region and the hydrophilic region in the ink blow-out holes 8.

Though described earlier, it is desired to heat-treat the nozzle plate from which the photosensitive resin film has been removed by dissolution at a temperature of from 350 to 400° C. in order to stabilize the water-repelling property, to increase the hardness of the plated film and to improve the resistance against the abrasion, after the fluorine-contained resin-containing nickel composite plating has been applied. For this purpose, therefore, the heat-treatment was conducted, too, in this Example at 350° C. for 1 hour. Due to this heat-treatment, the plated surface is covered with the molten cord-like fluorine-contained resin. By using a scanning-type electron microscope (SEM), furthermore, it was confirmed that fine fluorine-contained resin particles having a diameter of 0.3 $\mu$m had been uniformly dispersed in an amount of from 20 to 30% by volume in the fluorine-contained resin-containing nickel composite plated film.

In order to confirm the action and effect of the nozzle plate prepared in this Example, there was prepared a sample nozzle plate for comparison by applying the fluorine-contained resin-containing nickel composite plating in a manner as described above but without applying the ultrasonic waves in the plating solution bath. The nozzle plate of the Example and the sample nozzle plate for comparison were observed for their ink blow-out holes in cross section by using the SEM. In the nozzle plate of this Example, the distance of the fluorine-contained resin-containing nickel composite plating that has entered into the interiors of the ink blow-out holes from the ink blow-out surface was 10 $\mu$m in all ink blow-out holes. In the sample nozzle plate for comparison, on the other hand, the distance of the fluorine-contained resin-containing nickel composite plating that has entered into the ink blow-out holes from the ink blow-out surface irregularly varied over a range of from 0 to 7 $\mu$m.

The ink-jet heads having a constitution as shown in FIG. 1 were assembled by using the nozzle plate of Example and the sample nozzle plate for comparison, and a pigment-type ink was poured therein to conduct the continuous blow-out testing. The head using the nozzle plate of the Example stably blew out the ink. However, the head using the sample nozzle plate for comparison blew out the ink in deflected directions or did not quite blow out the ink.

According to the method of producing the nozzle plate for the ink-jet head of the present invention as will be understood from the foregoing results, the position of the boundary between the water-repelling region and the hydrophilic region becomes constant in every ink blow-out hole, enabling the ink to be stably blown out. Further, though the Example has dealt with the fluorine-contained resin-containing nickel composite plating based on the electrolytic nickel plating, it is obvious from a separate experiment that the same effect is obtained even with the fluorine-contained resin-containing nickel composite plating based on the non-electrolytic plating.

Example 4

A nozzle plate for the ink-jet head was assembled in the same manner as in the above-mentioned Example 3.

First, the photosensitive film was introduced into the predetermined boundary between the water-repelling region and the hydrophilic region in the ink blow-out holes in the nickel nozzle plate and was cured in the same manner as in Example 3. In this Example, too, the boundary between the water-repelling region and the hydrophilic region was located 10 $\mu$m deep from the ink blow-out surface like in Example 3.

Then, a bath containing the fluorine-contained resin-containing nickel composite plating solution of the following composition was established.

| | |
|---|---|
| Nickel sulfamate | 280 g/l |
| Nickel chloride | 30 g/l |
| Boric acid | 40 g/l |
| Polytetrafluoroethylene particles (average particle diameter, 0.3 μm) | 100 g/l |
| Dispersing agent | 0.1 g/l |

Figure 9:
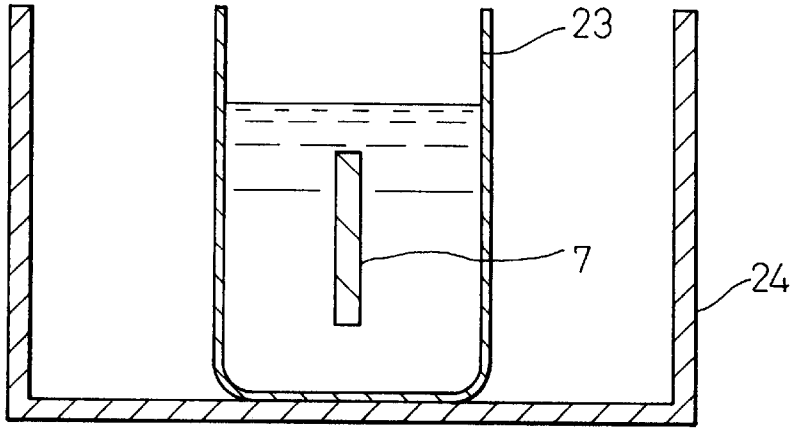
FIG. 9 is a sectional view illustrating a method of ultrasonic wave treatment during the production of the nozzle plate according to another preferred embodiment of the present invention.

The above plating solution was introduced into a beaker having a volume of 5 liters, and was put into an ultrasonic wave washing vessel schematically shown in FIG. 9. Though not shown in FIG. 9, the ultrasonic wave washing vessel 24 in which was placed the beaker 23 filled with the plating solution and containing the nozzle plate 7, was equipped with a mechanism for generating ultrasonic waves in the bottom portion thereof.

A Teflon™-coated heater of the immersion type was inserted in the beaker containing the nozzle plate and filled with the plating solution, and the temperature was adjusted to acquire a predetermined value. Then, the ultrasonic waves were applied under the following conditions.

| Ultrasonic wave-generating vessel | |
|---|---|
| | "SD-62CP BL" (trade name) manufactured by Sun Denshi Co. |
| Frequency | 37 KHz |
| Output | level 9 |
| Distance between the bottom of the vessel and the nozzle plate | 10 cm |
| Time for applying ultrasonic waves | 20 seconds |
| Temperature of the plating solution | 42° C. |

As in the case of the above-mentioned Example, the conditions for generating the ultrasonic waves are not limited to the above-mentioned conditions only, but optimum conditions can be found depending upon the volume of the plating bath, distance between the bottom of the ultrasonic wave washing vessel and the nozzle plate, and the arrangement of the nozzle plate in the plating bath.

After the treatment with the ultrasonic waves has been finished, the ultrasonic waves were no longer generated, and an electric current was supplied under the following conditions to start the electroplating.

| | |
|---|---|
| Temperature of the plating solution | 42° C. |
| Stirring | using a stirrer |
| Positive electrode | nickel plate |
| Negative electrode current density | 2 A/dm$^2$ |
| Swinging speed of nozzle plate | 3 m/min. |
| Plating time | 5 min. |

Through the above-mentioned series of steps, the fluorine-contained resin-containing nickel composite plating was applied maintaining a thickness of 3 μm onto the ink blow-out surface and into the interiors of the ink blow-out holes of the nickel nozzle plate.

Next, the photosensitive resin film that has terminated its role as the masking means was removed by dissolution using a solvent. As a result, there was obtained, as shown in FIG. 4, the nozzle plate for the ink-jet head in which the fluorine-contained resin-containing nickel composite plating 15 has entered into the ink blow-out holes 8 to clearly and constantly define the boundary 50 between the water-repelling region and the hydrophilic region in the ink blow-out holes 8. Then, the nozzle plate from which the photosensitive resin film has been removed by dissolution was heat-treated at 350° C. for one hour in an open atmosphere in order to increase the hardness of the surface of the plated film and to improve the resistance against the abrasion.

In order to confirm the action and effect of the nozzle plate prepared in this Example, there was prepared a sample nozzle plate for comparison by applying the fluorine-contained resin-containing nickel composite plating in a manner as described above but without applying the ultrasonic waves. The nozzle plate of the Example and the sample nozzle plate for comparison were observed in cross section by using the SEM. In the nozzle plate of this Example, the distance of the fluorine-contained resin-containing nickel composite plating had entered into the interiors of the ink blow-out holes from the ink blow-out surface was 10 μm in all ink blow-out holes. In the sample nozzle plate for comparison, on the other hand, the distance of the fluorine-contained resin-containing nickel composite plating that has entered into the ink blow-out holes from the ink blot-out surface irregularly varied over a range of from 0 to 8 μm.

The ink-jet heads having a constitution as shown in FIG. 1 were assembled by using the nozzle plate of Example and the sample nozzle plate for comparison, and a pigment-type ink was poured therein to conduct the continuous blow-out testing. The head using the nozzle plate of the Example stably blew out the ink. However, the head using the sample nozzle plate for comparison blew out the ink in deflected directions or did not properly blow out the ink.

According to the method of producing the nozzle plate for the ink-jet head of the present invention as will be understood from the foregoing results, the position of the boundary between the water-repelling region and the hydrophilic region becomes constant in every ink blow-out hole, enabling the ink to be stably blown out. Further, though the Example has dealt with the fluorine-contained resin-containing nickel composite plating based on the electrolytic nickel plating like in the above-mentioned Example 3, it is obvious that the same effect is obtained even with the fluorine-contained resin-containing nickel composite plating based on the non-electrolytic plating.

Example 5

In this Example, a nozzle plate for the ink-jet head generally shown in FIG. 2 and partly shown on an enlarged scale in cross section in FIG. 4, was prepared through the steps shown in series in FIGS. 10 to 16. The nozzle plate that is prepared will now be described with reference to FIG. 16 which is a sectional view corresponding to FIG. 4. The nozzle plate 7 has the fluorine-contained resin-containing nickel composite plating 15 covering the ink blow-out surface 17, the fluorine-contained resin-containing nickel composite plating 15 partly entering into the interiors of the ink blow-out holes 8. Owing to this constitution, a boundary 50 between the water-repelling region and the hydrophilic region is formed in the ink blow-out holes 8, stabilizing the position of meniscus at the time of blowing out the ink.

Figure 10:
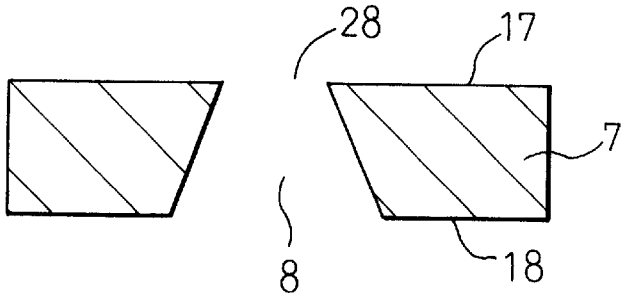
FIGS. 10 to 16 are sectional views illustrating the nozzle plate according to a preferred embodiment of the present invention, and the steps for producing the same.

First, the nozzle plate shown in FIG. 10 was prepared. As shown, the nozzle plate 7 is a flat plate member having a length of 20 mm, a width of 15 mm, a thickness of 0.1 mm and having many circular nozzles (ink blow-out holes) penetrating through therein. The ink blow-out holes 8 are tapered in cross section so that the ink smoothly passes and is blown out straight. That is, the nozzles 8 (ink blow-out holes 28) have a diameter of 35 μm on the side of the ink blow-out surface of the nozzle plate 7 and a diameter of 50 μm on the side of the ink blow-out back surface which is on the opposite side. The nozzle plate 7 used in this Example has 22 ink blow-out holes 8 arranged in line.

The nozzle plate 7 used here is a nickel plate produced by the electroforming method. It is, however, also allowable to obtain the nozzle plate by using other material, such as a stainless steel plate having ink blow-out holes formed by the plastic working, or a plastic material, a ceramic or silicon obtained by the injection-molding method like in the cases of the above-mentioned Examples.

Figure 11:
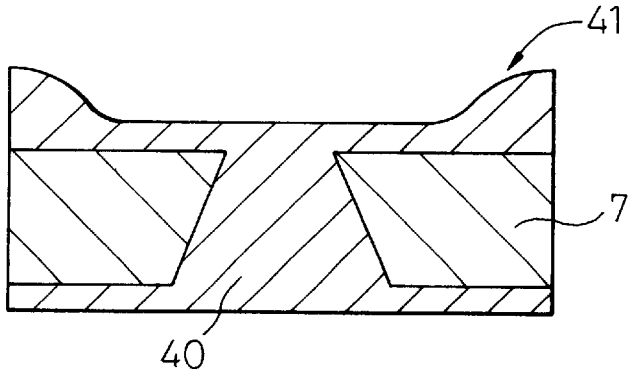

Then, as shown in FIG. 11, the positive-type photosensitive resin 40 was charged into the interior of the ink blow-out holes 8, and was further applied onto the ink blow-out surface 17 and the ink blow-out back surface 18, and was cured. For this purpose in this Example, the nozzle plate 7 was immersed in the liquid positive-type photosensitive resin 40, so that the interiors of the ink blow-out holes 8 were filled with the photosensitive resin. Thereafter, the nozzle plate 7 was pulled up, placed on an elastic material such as a silicone rubber sheet in a manner of being press-adhered thereto with the ink blow-out surface 17 being faced upward. Then, the liquid positive-type photosensitive resin was applied again by the spin-coating method and was then fired. In this Example, a positive-type photosensitive resist, "OFPR-800" (trade name) having a viscosity of 30 centipoises manufactured by Tokyo Oka Co., was used as the positive-type photosensitive resin. The spin-coating conditions consisted of revolving, first, at a rotational speed of 300 rpm for 10 seconds and, then, revolving at a rotational speed of 2000 rpm for 10 seconds.

In order to fill the interiors of the ink blow-out holes 8 with the positive-type photosensitive resin 40, it is most desired to use a liquid positive-type photosensitive resin having a low viscosity of not larger than 100 centipoises. In order to more reliably fill the interiors of the ink blow-out holes 8 with the positive photosensitive resin 40, it is desired to apply ultrasonic waves from the external side in a state where the nozzle plate 7 is immersed in a solution in which the positive-type photosensitive resin 40 is dissolved.

Thus, the positive-type photosensitive resin 40 was introduced into the ink blow-out holes 8 and was applied onto the ink blow-out surface 17 and the ink blow-out back surface 18, and was fired on a hot plate. The firing was conducted under the conditions of a temperature on the hot plate of 110° C. for a period of 90 seconds. After the step of firing, the thickness of the film of the positive-type photosensitive resin 40 on the ink blow-out surface 17 was measured. It was found that the positive-type photosensitive resin 40 had been applied maintaining a uniform thickness of about 2.0 μm near the ink blow-out holes 8, and had been locally thickly applied in a thickness over a range of from about 5 to about 10 μm in the surrounding 41 of the ink blow-out surface. In this Example, the surrounding 41 of the ink blow-out surface stands for a range of up to about 5 mm from the end of the surrounding to the inner portion of the nozzle plate. However, the surrounding 41 of the ink blow-out surface may vary depending on the size and shape of the nozzle plate.

Figure 12:
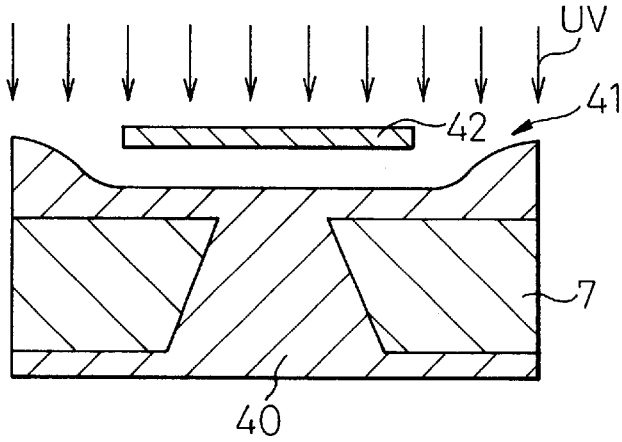
Figure 17:
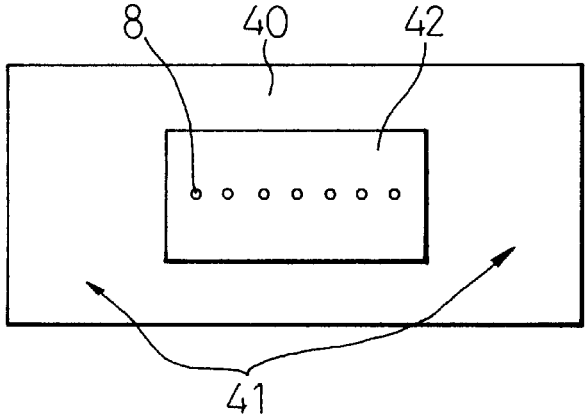
FIG. 17 is a plan view illustrating a preferred example of a step of selective exposure shown in FIG. 12.

Referring next to FIG. 12, a mask 42 that does not transmit ultraviolet rays was installed on a portion of the ink blow-out surface 17 inclusive of the ink blow-out holes 8, and the nozzle plate was irradiated with ultraviolet rays (see arrows UV) of an intensity of 10 mW/cm$^2$ having a wavelength of 436 nm from the side of the ink blow-out surface 17. The step of exposure to ultraviolet rays is for completely removing, by developing, the positive-type photosensitive resin 40 thickly applied onto the surrounding 41 of the ink blow-out surface 17. In order to completely remove the positive-type photosensitive resin 40 having a large thickness, the exposure time must not be shorter than 30 seconds. In this Example, the exposure time was set to be 40 seconds. FIG. 17 is a plan view of when the nozzle plate is viewed from the upper side of the ink blow-out surface for explaining the arrangement of the mask 42 in FIG. 12. As will be understood from FIG. 17, a portion of the ink blow-out surface inclusive of the ink blow-out holes 8 is shielded by the mask 42 that does not transmit the ultraviolet rays. Though there is no particular limitation on the material, thickness, size and shape of the mask 42 or on the distance of the mask 42 from the ink blow-out surface, it is desired that the mask covers the region of the ink blow-out holes 8 but has an area as small as possible for removing the positive-type photosensitive resin 40 over a range as wide as possible from the ink blow-out surface.

Figure 13:
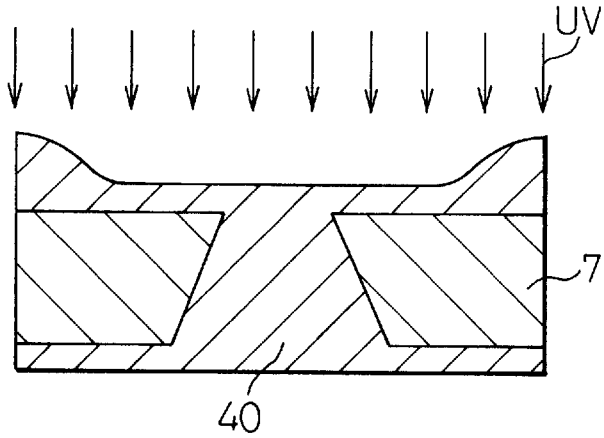
Figure 14:
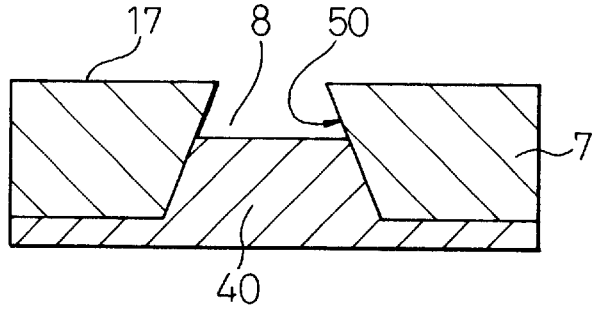

Next, as shown in FIG. 13, the mask 42 used in the preceding step was removed, and the nozzle plate was irradiated again with ultraviolet rays (see arrows UV) having an intensity of 10 mW/cm$^2$ and a wavelength of 436 nm from the side of the ink blow-out surface 17. The step of exposure to ultraviolet rays is an important step for determining a predetermined boundary position between the water-repelling region and the hydrophilic region in the ink blow-out holes 8. After the exposure to ultraviolet rays has been finished, the nozzle plate was immersed in an alkaline developing solution (NMD-3, manufactured by Tokyo Oka Co.) maintained at 25° C. for 90 seconds to remove by dissolution the portion exposed to the ultraviolet rays from the positive-type photosensitive resin 40. There was obtained a nozzle plate 7 in a state where the positive-type photosensitive resin 40 has been removed from a portion of the ink blow-out holes 8 as shown in FIG. 14. As foreseen by the present inventors, it was clarified that the boundary position 50 (expected position) between the water-repelling region and the hydrophilic region varied depending upon the intensity of the ultraviolet rays and the exposure time. In other words, the dissolving amount of the positive-type photosensitive resin 40, i.e., the distance from the ink blow-out surface 17 from where the positive-type photosensitive resin 40 is removed up to the positive-type photosensitive resin 40, can be correctly controlled by controlling the intensity of the ultraviolet rays and the exposure time. In this Example, the time for exposure to ultraviolet rays was set to be 5 seconds, so that the distance from the ink blow-out surface 17 to the positive-type photosensitive resin 40 in the ink blow-out holes 8 was 10 μm.

In this Example as described above, the mask 42 that does not transmit the ultraviolet rays was installed over the ink blow-out surface 17, the ultraviolet rays were projected from the side of the ink blow-out surface 17, the mask 42 that does not transmit ultraviolet rays was removed, and the ultraviolet rays were projected again from the side of the ink blow-out surface 17. However, these steps may be conducted in the reverse order. That is, the ultraviolet rays are projected from the side of the ink blow-out surface 17 in a state where there is no mask 42 for determining the predetermined boundary position between the water-repelling region and the hydrophilic region, the mask 42 is then installed, and the ultraviolet rays are projected again from the side of the ink blow-out surface 17 to obtain the same effect.

Figure 15:
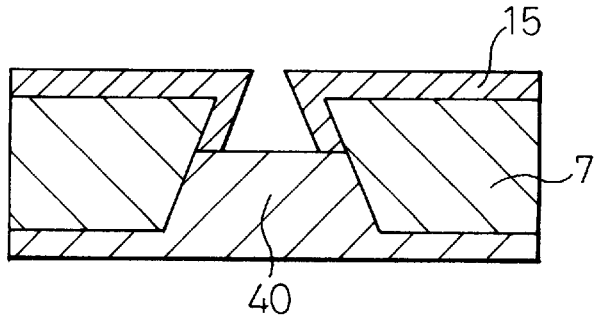
Figure 16:
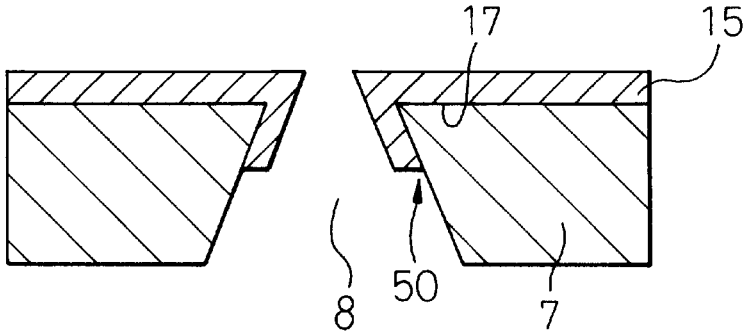

Then, as shown in FIG. 15, the fluorine-contained resin-containing nickel composite plating 15 was applied onto the ink blow-out surface 17 and into the ink blow-out holes 8. If additionally described, the fluorine-contained resin-containing nickel composite plating can be conducted in a manner of either the electroplating or non-electrolytic plating. In this Example, however, the electroplating was employed by using "Metafron-FS" (trade name, produced by Uemura Kogyo Co.) as a plating solution. The plating conditions were as follows:

| | |
|---|---|
| Temperature of the plating solution | 42° C. |
| Stirring | using a stirring pump |
| Positive electrode | nickel plate |
| Negative electrode current density | 2 A/dm$^2$ |
| Swinging speed of nozzle plate | 3 m/min. |
| Plating time | 5 min. |

Through the electroplating under the above-mentioned conditions, the fluorine-contained resin-containing nickel composite plated film 15 was applied maintaining a thickness of 3 $\mu$m onto the ink blow-out surface 17 and into the ink blow-out holes 8. The thickness of the plated film can be controlled relying on the negative electrode current density and the plating time. Through study, however, the present inventors have learned that the thickness of the plated film must not be smaller than 2.0 $\mu$m and, preferably, not smaller than 3.0 $\mu$m to obtain the desired water-repelling property.

Next, the positive-type photosensitive resin 40 was dissolved and removed by using a special peeling solution ("Peelant-104", produced by Tokyo Oka Co.). As a result, there was completed a nozzle plate 7 for the ink-jet head in which the fluorine-contained resin-containing nickel composite plating 15 has entered into the ink blow-out holes 8 to clearly define the boundary position between the water-repelling region and the hydrophilic region in the ink blow-out holes 8.

In conducting the Example of the present invention, it is desired to heat-treat the nozzle plate at a temperature of from 350 to 400° C. after the positive-type photosensitive resin has been dissolved and removed, in order to stabilize the water-repelling property, to increase the hardness of the plated film and to enhance the abrasion resistance, after the step of applying the fluorine-contained resin-containing nickel composite plating. In this Example, too, therefore, the heat-treatment was conducted at a temperature of 350° C. for 1 hour after the step of applying the fluorine-contained resin-containing nickel composite plating. Due to the heat-treatment, the surface of the plating was covered with the molten cord-like fluorine-contained resin. It was confirmed by using the electron microscope that the fine particles of fluorine-contained resin having a diameter of 0.3 $\mu$m was uniformly dispersed in the fluorine-contained resin-containing nickel composite plated film in an amount of from 20 to 30% by volume.

In order to confirm the action and effect of the nozzle plate prepared in this Example, a sample nozzle plate for comparison was prepared by applying thereon the fluorine-contained resin-containing nickel composite plating in the same manner as described above but omitting the step of selective exposure to ultraviolet rays of FIG. 12 (omitting the step of projecting the ultraviolet rays from the side of the ink blow-out surface by installing a mask that does not transmit the ultraviolet rays on a portion of the ink blow-out surface inclusive of the ink blow-out holes of the nozzle plate on which the positive-type photosensitive resin has been applied). The sample for comparison was heat-treated and was mounted on the head. The sample nozzle plate for comparison was prepared through the step that is simply described below.

First, the positive-type photosensitive resin was introduced into the ink blow-out holes in the nozzle plate and onto the ink blow-out surface and onto the ink blow-out back surface, and was cured. Then, in order to form the boundary between the water-repelling region and the hydrophilic region in the ink blow-out holes, the ultraviolet ray having an intensity of 10 mW/cm$^2$ and a wavelength of 436 mn were projected for 5 seconds from the side of the ink blow-out surface. Thereafter, the nozzle plate was immersed in an alkaline developing solution (NMD-3, produced by Tokyo Oka Co.) maintained at 25° C. for 90 seconds, to remove by dissolution the portion exposed to ultraviolet rays. After the developing, the fluorine-contained resin-containing nickel composite plating was applied onto the ink blow-out surface and into the ink blow-out holes. Next, the positive-type photosensitive resin that is no longer necessary was removed by dissolution by using a special peeling solution ("Peelant-104", produced by Tokyo Oka Co.). As a result, there was completed a nozzle plate for the ink-jet head having the fluorine-contained resin-containing nickel composite plating introduced into the ink blow-out holes to clearly define the boundary position between the water-repelling region and the hydrophilic region.

The nozzle plate of this Example and the sample nozzle plate for comparison were observed for their surfaces on the ink blow-out surfaces by using a metallographical microscope. In the nozzle plate of this Example, the surface of the ink blow-out surface had been uniformly coated with the fluorine-contained resin-containing nickel composite plating, and no defect was observed in the plated film. In the sample nozzle plate for comparison, however, many spot-like defects were observed without the fluorine-contained resin-containing nickel composite plating surrounding the ink blow-out surface.

The ink-jet heads shown in FIG. 1 were assembled by using the nozzle plate of this Example and the sample nozzle plate for comparison, and the pigment-type ink was poured therein to conduct the continuous blow-out testing. The head using the nozzle plate of this Example stably blew out the ink. The head using the sample nozzle plate for comparison stably blew out the ink, too, at first. However, the direction of blowing out the ink was gradually deflected and, eventually, no ink was blown out. To determine the cause, the ink blow-out surfaces after the continuous blow-out testing were observed by using the metallographical microscope. No change took place in the nozzle plate of this Example. In the sample nozzle plate for comparison, however, it was observed that the fluorine-contained resin-containing nickel composite plating that had been covering the ink blow-out surface of the nozzle plate was peeling off over wide areas. This is presumably due to the fact that the ink adhered on the ink blow-out surface had infiltrated into between the underlying substrate and the fluorine-contained resin-containing nickel composite plating through defects in the plated film, causing the underlying substrate to be corroded.

Example 6

In this Example, the nozzle plate for the ink-jet head generally shown in FIG. 2 and partly shown in FIG. 18 on an enlarged scale in cross section, was prepared according to the steps shown in series in FIGS. 19 to 22. The nozzle substrate used in this Example was a nickel plate, obtained by an electroforming method, having a smooth surface of a roughness Ra of about 0.01 μm in order to facilitate the operation for controlling the surface roughness by the fine surface-finishing treatment. Here, the surface roughness Ra of the nozzle substrate does not limit the present invention. When the nozzle substrate has a large surface roughness Ra, the fluorine-contained resin eutectoid plating is thickly applied to execute fine surface-finishing treatment, making it possible to obtain a surface state like that of the present invention. Besides, the ink blow-out holes are tapered in cross section and have a diameter of 35 μm on the side of the ink blow-out surface of the nozzle substrate and a diameter of 50 μm on the side of the ink blow-out back surface, so that the ink smoothly passes and is blown out straight. The nozzle substrate has 30 ink blow-out holes arranged in line.

First, a positive-type photoresist, "OFPR-800" (trade name) produced by Tokyo Oka Co. having a viscosity of 30 centipoises, was prepared as a filler, and was uniformly applied by the spin-coating method onto the whole surface of the nozzle plate so as to be introduced into the ink blow-out holes. After the resist film was pre-baked, the nozzle plate was irradiated with ultraviolet rays from the side of the ink blow-out surface while controlling the exposure time and the amount of exposure to light, and was then developed with a special developing solution, NMD-W, produced by Tokyo Oka Co. As shown in FIG. 19, the filler 40 could be removed by dissolution up to the boundary 50 in the ink blow-out holes 8 in the nozzle plate 7. The filler 40 that is remaining is for use as a masking means in the subsequent step of conducting the fluorine-contained resin eutectoid plating.

Next, as shown in FIG. 20, the fluorine-contained resin eutectoid plating was applied onto the exposed portion of the nozzle plate 7. In the step of applying the fluorine-contained resin eutectoid plating, the surface of the nozzle plate 7 was activated by using the aqueous solution of hydrochloric acid, nickel chloride was strike-plated at a current density of 6 $A/dm^2$ for 2 minutes, the nozzle plate was washed with pure water, and the fluorine-contained resin eutectoid plating was applied thereon. The fluorine-contained resin eutectoid plating was effected by using "Metafron FS" (trade name) produced by Uemura Kogyo Co. as a plating solution with stirring at a solution temperature of 42° C. at a current density of 2 $A/dm^2$ in order to form a fluorine-contained resin eutectoid plated film 15 maintaining a thickness of about 3 μm.

After the fluorine-contained resin eutectoid plated film was formed, the filler (positive-type photoresist) used as the masking means for the plating was removed by using the special peeling solution 104. As shown in FIG. 21, the fluorine-contained resin eutectoid plated film 15 only remained at predetermined portions of the nozzle plate 7 as shown in FIG. 21. In this step, the surface of the film 15 is expressed as the surface 15*a*.

Then, as shown in FIG. 22, the surface of the fluorine-contained resin eutectoid plated film 15 was finely finished. In this Example, the surface was finished by lapping to acquire a surface roughness Ra of 0.05 μm. The surface of the film 15 after being treated is expressed as the surface 15*b*.

Finally, though not illustrated, the nozzle plate, after the surface was finely finished, was heat-treated at a high temperature. The heat-treatment was conducted at a temperature of 350° C. which was higher than the melting point (about 327° C.) of PTFE for about 1 hour. In conducting the heat-treatment, the PTFE thermally decomposes at around 400° C. It is therefore important to so control the heat-treating temperature to not exceed 400° C.

In order to confirm the action and effect of the nozzle plate produced in this Example, a sample nozzle plate for comparison was produced in the same manner as described above through the heat-treatment but without finely finishing the surface. The obtained nozzle plate possessed the surface roughness Ra of about 0.015 μm.

The nozzle plate of this Example and the sample nozzle plate for comparison were subjected to the wiping test (abrasion resistance testing) by pushing a wiping rubber of a width of 10 mm thereon with a load of 100 g. The adhered state of PTFE on the cross section was observed by using an electron microscope, and the following results were observed.

[Sample Nozzle Plate for Comparison]

Figure 26:
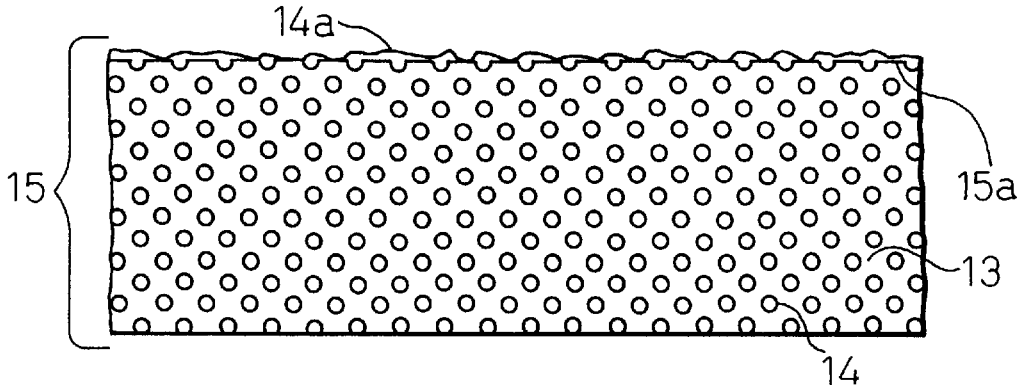
FIG. 26 is a sectional view illustrating a state (before the wiping testing) near the surface of the film plated on the nozzle plate which is a sample for comparison.

Prior to the testing: As shown in FIG. 26, the surface of the fluorine-contained resin eutectoid plated film 15 acquired the surface 15*a*, and the heat-treated fluorine-contained resin 14*a* had been adhered thereon.

Figure 27:
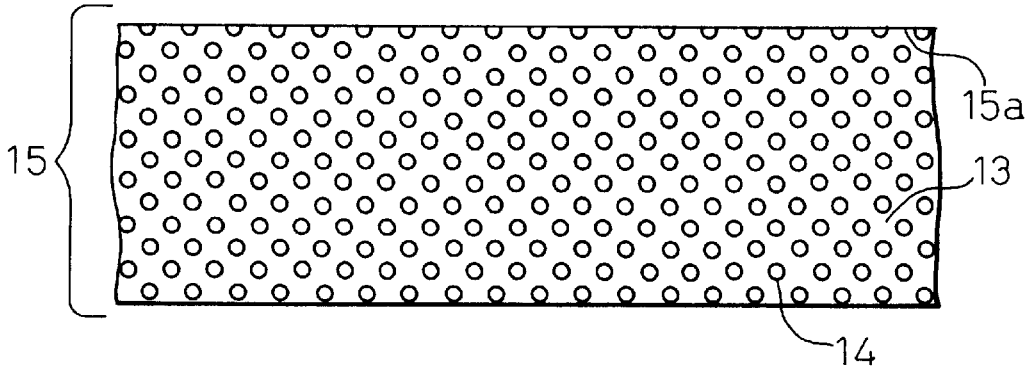
FIG. 27 is a sectional view illustrating a state (after the wiping testing) near the surface of the film plated on the nozzle plate which is a sample for comparison.

After the testing: As shown in FIG. 27, the PTFE was scraped off the surface 15*a* of the fluorine-contained resin eutectoid plated film 15, and the fluorine-contained resin 14 was observed as only dispersed in the film 15.

[Nozzle Plate of this Example]

Prior to the testing: As shown in FIG. 23, the surface of the fluorine-contained resin eutectoid plated film 15 acquired the surface 15*b* which had been covered with the fluorine-contained resin 14*a*.

Figure 28:
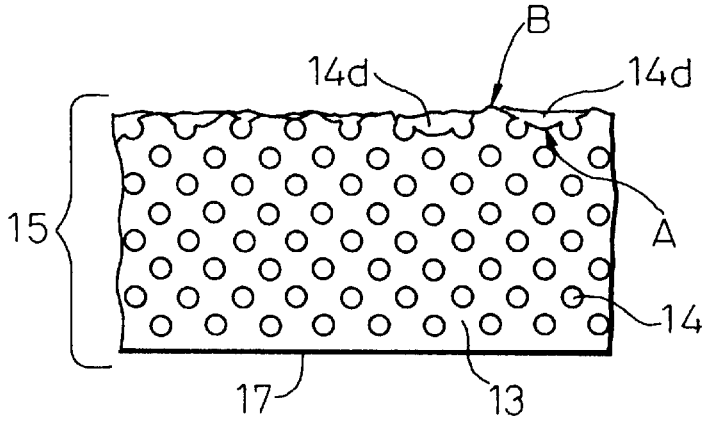
FIG. 28 is a sectional view illustrating a state (after the wiping testing) near the surface of the film plated on the nozzle plate according to the present invention.

After the testing: As shown in FIG. 28, there was observed the fluorine-contained resin 14*d* that had migrated into the recessed portions (indicated by an arrow A) in the surface of the fluorine-contained resin eutectoid plated film 15, and the protruded portions (indicated by an arrow B) of nickel matrix partly appeared on the surface. However, the surface mostly remained covered with the fluorine-contained resin 14*d*. The fluorine-contained resin 14*d* does not necessarily have sufficiently large resistance against the abrasion, but is protected by protruded portions that appear on the surface due to suitable degree of roughness in the surface. As a result, the fluorine-contained resin 14*d* continues to cover the surface of the nozzle plate.

The ink-jet heads having a constitution shown in FIG. 1 were assembled by using the nozzle plate of this Example and the sample nozzle plate for comparison, and the dye-type ink was poured therein to repetitively conduct the ink blow-out testing and the wiping testing. The head using the nozzle plate of this Example stably blew out the ink even when the ink blow-out direction was already deviated by using the head with the sample nozzle plate for comparison. The same testing was conducted by using the pigment-type ink. The head using the nozzle plate of this Example stably blew out the ink even when the ink blow-out direction was already deviated and the ink failed to be blown out, due to the adhesion and solidification of ink, using the head with the sample nozzle plate for comparison.

As a comparative example, furthermore, a nozzle substrate having a surface roughness Ra of about 0.2 μm was used to prepare a nozzle coated with the fluorine-contained resin eutectoid plated film of which the surface roughness Ra was not smaller than 0.2 μm, and the testing was conducted in the same manner as described above. However, the ink droplets were not wiped off to a sufficient degree, and the ink readily adhered and solidified making it difficult to blow out the ink.

It was so far considered that the ink blow-out surface of the nozzle plate was better when as smooth as possible. According to this Example, however, it was learned that a suitable degree of surface roughness is necessary for preparing a nozzle plate having an ink blow-out surface that features excellent durability. To clarify this range, a variety of surface finishing methods were tested, and it was learned that a method generally called fine surface finishing treatment offers relatively good results. Among them, the mirror surface grinding, superfinishing, honing, lapping and electrolytic polishing are effective methods. When the surface roughness Ra was controlled to lie over a range of from 0.02 to 0.1 $\mu$m, in particular, a further improved durability was exhibited.

Example 7

Figure 29:
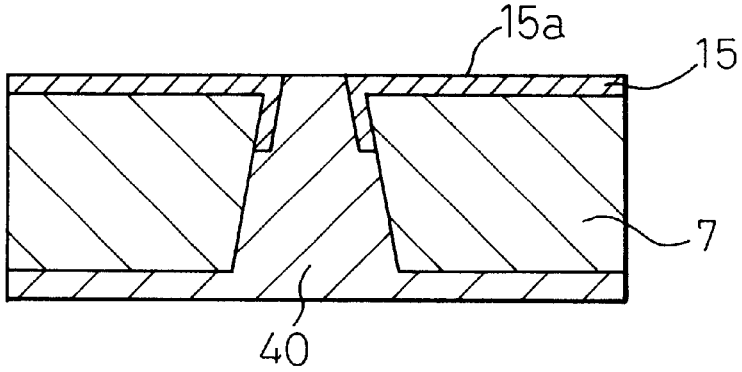
FIGS. 29 to 31 are sectional views illustrating the nozzle plate according to a further preferred embodiment of the present invention, and the steps for producing the same.
Figure 30:
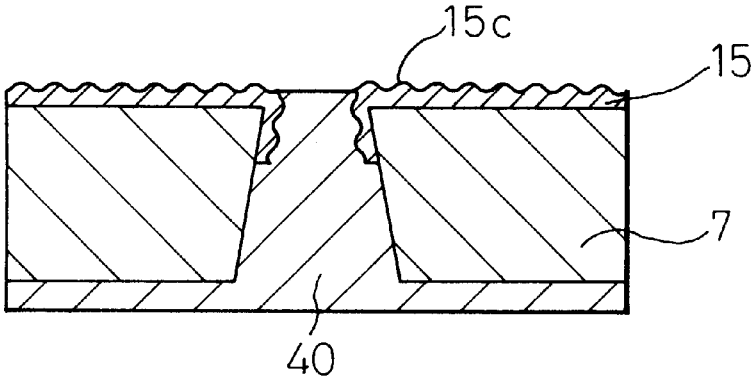
Figure 31:
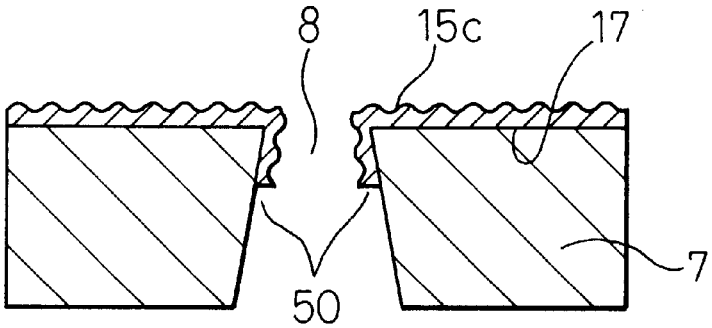

The procedure of Example 6 was repeated. In this Example, however, the fluorine-contained resin eutectoid plated film 15 was applied as shown in FIG. 20 and, then, the nozzle plate 7 was filled with the filler 40 again near the surface 15*a* of the film 15 as shown in FIG. 29. Then, as shown in FIG. 30, the surface was finely finished in the same manner as in Example 6 to form the surface 15*c* having a surface roughness Ra of 0.05 $\mu$m. Then, as shown in FIG. 31, the filler 40 was removed and, then, the nozzle plate 7 was heat-treated at a temperature higher than the melting point of the fluorine-contained resin.

By using the nozzle plate produced in this Example, the ink-jet head was assembled in the same manner as in Example 6, and the ink blow-out testing and the wiping testing were repeated by using the dye-type ink and the pigment-type ink. The ink was blown out very stably as in the nozzle plate of Example 6. In this Example, furthermore, the finely finished surface was limited to the ink blow-out surface. Therefore, the behavior of meniscus of the ink in the ink blow-out holes was not at all affected, making it possible to improve the durability of the ink blow-out surface and, hence, to produce a nozzle plate having excellent reliability.

Example 8

Figure 34:
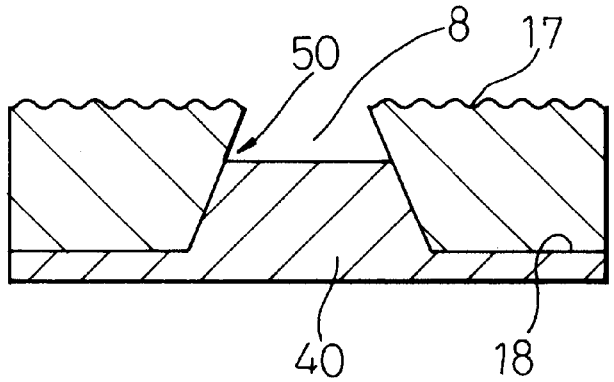
Figure 35:
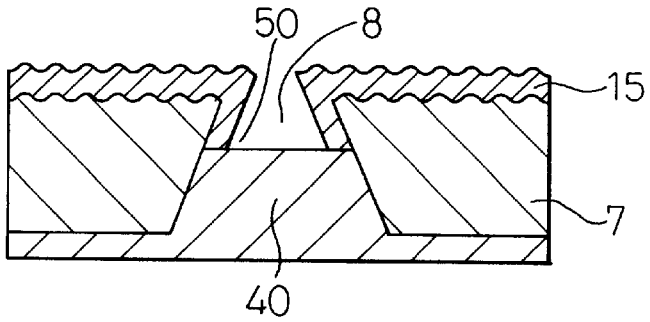
Figure 36:
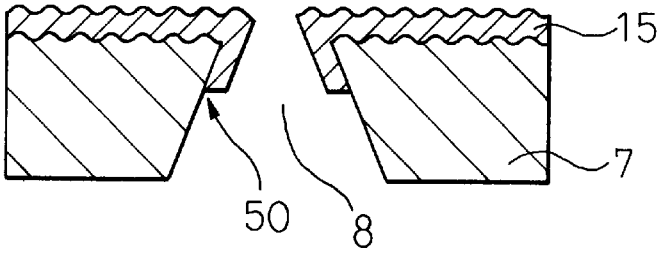

In this Example, the nozzle plate generally shown in FIG. 2 was produced through the steps shown in series in FIGS. 32 to 36. In particular, FIG. 36 is a sectional view schematically illustrating the nozzle plate after the nozzle plate for the ink-jet head of this Example is completed. In FIG. 36, the nozzle plate 7 has the fluorine-contained resin-containing nickel composite plating 15 which is the water-repelling film applied onto the rough ink blow-out surface 17, the fluorine-contained resin-containing nickel composite plated film 15 partly entering into the ink blow-out holes 8.

Figure 32:
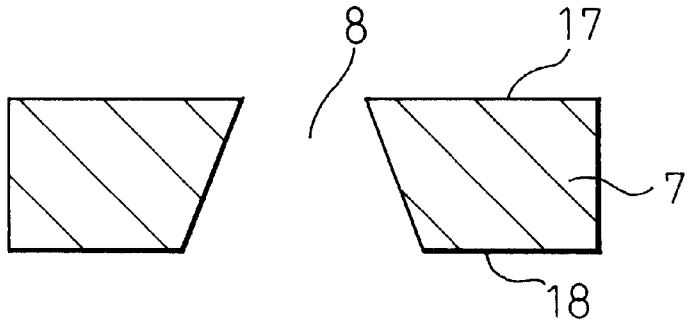
FIGS. 32 to 36 are sectional views illustrating the nozzle plate according to a still further preferred embodiment of the present invention, and the steps for producing the same.

First, a nozzle plate having a cross section shown in FIG. 32 was prepared. The nozzle plate 7 prepared here was a flat plate member having a length of 20 mm, a width of 15 mm, a thickness of 0.1 mm, and many circular ink blow-out holes 8 penetrating therethrough. The ink blow-out holes 8 were tapered in cross section having a diameter of 35 $\mu$m on the side of the ink blow-out surface 17 of the nozzle plate 7 and a diameter of 50 $\mu$m on the side of the ink blow-out back surface 18, so that the ink could be smoothly passed and blown out straight. In this nozzle plate 7, twenty two (22) ink blow-out holes 8 were arranged in line.

The nozzle plate 7 used in this Example was a nickel plate obtained by an electroforming method. As described in the foregoing Examples, however, the nozzle plate may be made of other materials, such as a stainless steel plate in which the ink blow-out holes are formed by plastic working, or may be made of a plastic material, a ceramic or silicon obtained by the injection-molding method.

Figure 33:
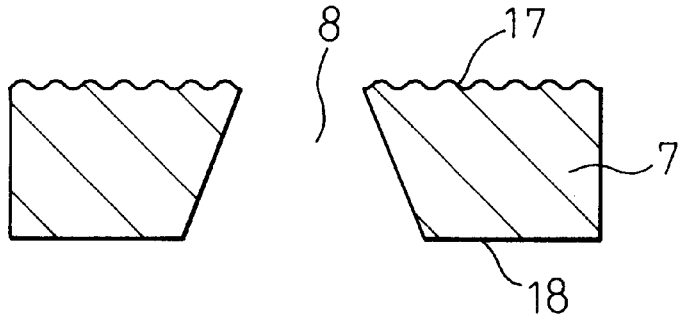

Next, as shown in FIG. 33, the ink blow-out surface 17 of the nozzle plate 7 was formed rough in advance. In this Example, roughness was formed by lapping by using a grinding agent of diamond particles having a particle diameter of 3 $\mu$m. Due to this working, the ink blow-out surface 17 was uniformly formed rough having a height over a range of from 0.1 $\mu$m to 0.3 $\mu$m.

The ink blow-out surface 17 may be formed rough by any method other than the lapping. For example, there can be employed a lapping method using an emery paper, a honing working for making the surface coarse by blowing fine particles of silicon carbide at high speeds, an etching working based on a plasma, a physical method such as laser machining, a mechanical etching using a corrosive solution, or a chemical method such as electrolytic polishing. An optimum method can be selected depending upon the material of the nozzle plate 7 and the desired degree of roughness.

Referring next to FIG. 34, in order to form the fluorine-contained resin-containing nickel composite plating (see reference numeral 15 in FIG. 36) on the ink blow-out surface 17 and in the ink blow-out holes 8, a photosensitive resin film 40 having a thickness of 50 $\mu$m was brought into pressed contact with the ink blow-out back surface 18 of the nozzle plate 7 under the application of a predetermined temperature and pressure, and the film was partly introduced into the ink blow-out holes up to a predetermined boundary position 50 between the water-repelling region and the hydrophilic region, that gives an optimum meniscus position. In this Example, the temperature and pressure applied to the photosensitive resin film 40 were so adjusted that the distance was 10 $\mu$m from the ink blow-out surface 17 in the ink blow-out holes 8 to the photosensitive resin film 40.

The object of using the photosensitive resin film is to clearly define the boundary between the end of the fluorine-contained resin-containing nickel composite plating 15 and the region where the fluorine-contained resin-containing nickel composite plating is not applied, i.e., to clearly define the boundary position 50 between the water-repelling region and the hydrophilic region, since the fluorine-contained resin-containing nickel composite plating 15 that is introduced into the ink blow-out holes 8 determines the meniscus position of the ink to seriously affect the ink blow-out characteristics.

Then, as shown in FIG. 35, the fluorine-contained resin-containing nickel composite plating 15 was applied onto the ink blow-out surface 17 and into the ink blow-out holes 8 (regions on where the photosensitive resin film 40 has not been applied). The fluorine-contained resin-containing nickel composite plating 15 may be formed by either electroplating or non-electrolytic plating. In this Example, the electroplating was employed by using "Metafron-FS" (trade name, produced by Uemura Kogyo Co.) as a plating solution. The plating conditions were as follows:

| | |
|---|---|
| Temperature of the plating solution | 42° C. |
| Stirring | using a stirring pump |
| Positive electrode | nickel plate |
| Negative electrode current density | 2 A/dm$^2$ |
| Swinging speed of nozzle plate | 3 m/min. |
| Plating time | 5 min. |

Through the electroplating under the above-mentioned conditions, the fluorine-contained resin-containing nickel composite plated film 15 was applied to a thickness of 3 μm onto the ink blow-out surface 17 and into the ink blow-out holes 8. The thickness of the plated film can be controlled relying on the negative electrode current density and the plating time. Through study, however, the present inventors have found that the thickness of the plated film must not be smaller than 2.0 μm and, preferably, not smaller than 3.0 μm for obtaining the desired water-repelling property.

Though this was described in the foregoing Example, the water-repelling film may comprise a material containing the fluorine-contained resin other than nickel, such as a fluorine-contained resin or a silicone resin. Through study, however, the present inventors have learned that the fluorine-contained resin-containing nickel composite plating using nickel or a nickel alloy having a hardness larger than the above resins, as a matrix, exhibits more excellent durability than the water-repelling film comprising the fluorine-contained resin or the silicone resin alone.

Next, the photosensitive resin film 40 that is no longer necessary was removed by dissolution by using a special peeling solution. Thus, there was completed, as shown in FIG. 36, the nozzle plate 7 for the ink-jet head in which the fluorine-contained resin-containing nickel composite plating 15 was introduced into the ink blow-out holes 8 to define a clear and constant boundary position 50 between the water-repelling region and the hydrophilic region in the ink blow-out holes 8.

After the fluorine-contained resin-containing nickel composite plating has been applied, the photosensitive resin film was removed by dissolution in the preceding step in order to stabilize the water-repelling property and to increase the abrasion resistance by increasing the hardness of the plated film. Thereafter, the nozzle plate was heat-treated at a temperature of from 350° C. for 1 hour. It is usually desired that the heat-treatment is conducted at a temperature of from 350 to 400° C. Due to the heat-treatment, the surface of the plating was covered with the molten cord-like fluorine-contained resin. It was confirmed by using the scanning-type electron microscope (SEM) that the fine particles of fluorine-contained resin having a diameter of 0.3 μm was uniformly dispersed in the fluorine-contained resin-containing nickel composite plated film in an amount of from 20 to 30% by volume. In the fluorine-contained resin-containing nickel composite plated film on the ink blow-out surface of the nozzle plate, furthermore, it was measured that the height of roughness in the surface was within a range of from 0.1 to 0.3 μm, and it was confirmed that the height of roughness formed in the ink blow-out surface of the nozzle plate had been correctly transferred in the first step.

In this connection, the height of roughness formed in the ink blow-out surface was set in this Example to lie within a range of from 0.1 μm to 0.3 μm. Through a study conducted by the present inventors, however, it was learned that the effect of the present invention is not exhibited unless the height is at least not smaller than 0.1 μm, and the upper limit in the height is not larger than the thickness of the water-repelling film.

Figure 37:
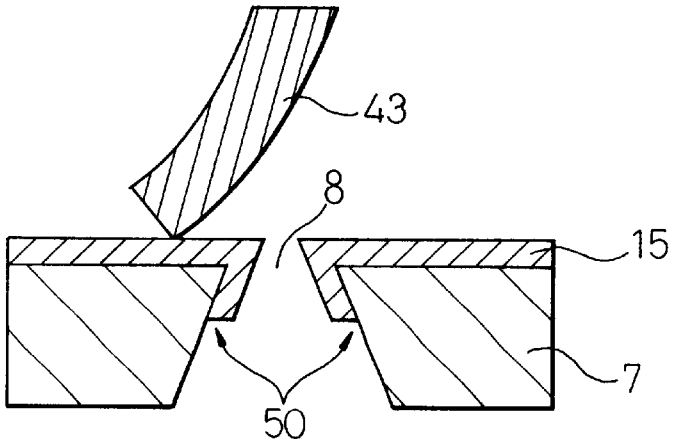
FIG. 37 is a sectional view illustrating a method of wiping testing conducted for evaluating the durability of the nozzle plate according to the present invention.

In order to confirm the action and effect of the nozzle plate prepared in this Example, a sample nozzle plate for comparison was prepared by applying thereon the fluorine-contained resin-containing nickel composite plating in the same manner as described above but without forming a roughness on the ink blow-out surface. The ink-jet heads of the constitution shown in FIG. 1 were assembled by using the nozzle plate of this Example and the sample nozzle plate for comparison, and the durability testing was conducted by wiping the fluorine-contained resin-containing nickel composite platings on the ink blow-out surfaces of the nozzle plates many times in one direction. The test was conducted by using a wiping mechanism made of a blade 43 of an elastic rubbery material shown in FIG. 37 (schematic diagram illustrating the cleaning mechanism for wiping using a blade of an elastic rubbery material). The conditions of the durability testing were as follows:

Load: 100 g/cm$^2$ wiping speed: 2 cm/sec.

Number of times of wiping: 10,000 times

Prior to conducting the durability testing, pure water was dropped on the ink blow-out surfaces of the nozzle plates, and contact angles of the water droplets were measured in compliance with the measuring method described earlier with reference to FIG. 6. The contact angles were each 120° on the nozzle plate of this Example and on the sample nozzle plate for comparison, indicating that both nozzle plates possessed water-repelling property.

Then, after the durability testing was conducted under the above-mentioned conditions, pure water was dropped on the wiped regions of the fluorine-contained resin-containing nickel composite plating to measure the contact angles of the water droplets. The nozzle plate of this Example exhibited a contact angle of 120° which was the same as the value before the testing was conducted. However, the sample nozzle plate for comparison exhibited a contact angle of 30° indicating a great reduction in the water-repelling property. The reduction in the water-repelling property further proves the fact that the fluorine-contained resin-containing nickel composite plating on the sample nozzle plate for comparison has poor durability against the wiping.

The heads were newly assembled by using the nozzle plate of this Example and the sample nozzle plate for comparison, and the pigment-type ink was poured into these heads to continuously blow out the ink for 10 minutes. Thereafter, the blow-out testing for wiping the surface of the fluorine-contained resin-containing nickel composite plating one time, was repeated. The head assembled by using the nozzle plate of this Example could effect the printing at all times. However, the head assembled by using the sample nozzle plate for comparison could normally blow out the ink at first but gradually blew out the ink in deflected directions and finally failed to blow out the ink. After the blow-out testing, the fluorine-contained resin-containing nickel composite platings on the ink blow-out surfaces were observed by using a metallographical microscope. It was confirmed that almost no ink remained adhered on the surface of the fluorine-contained resin-containing nickel composite plating on the ink blow-out surface of the head assembled by using the nozzle plate of this Example, but the ink remained adhered on the whole ink blow-out surface of the head assembled by using the sample nozzle plate for comparison.

Example 9

In this Example, the nozzle plate partly shown on an enlarged scale in cross section in FIG. 38 was produced through the steps shown in series in FIGS. 39 to 43.

Figure 39:
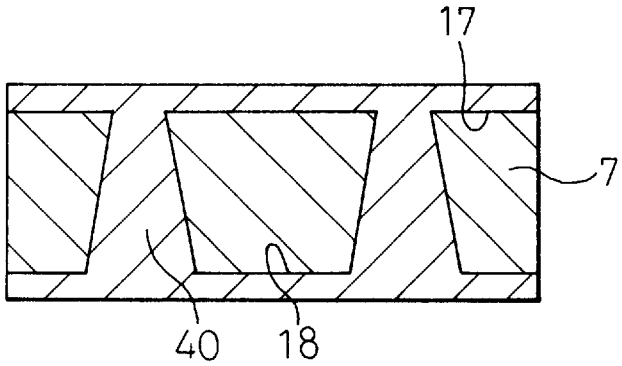
FIGS. 39 to 43 are sectional views illustrating the preferred steps for producing the nozzle plate shown in FIG. 38.

First, as shown in FIG. 39, the whole surface of the nozzle plate 7 was covered with the filler 40 of the positive-type photosensitive material. As shown, the ink blow-out surface 17, ink blow-out back surface 18 and the interiors of the ink blow-out holes 8 of the nozzle plate 7 were covered with the filler 40 of the positive-type photosensitive material. Here, the nozzle plate 7 was the nickel plate obtained by the electroforming method. The ink blow-out holes 8 were tapered in cross section and possessed a diameter of 35 μm on the side of the ink blow-out surface 17, and a diameter of 50 μm on the side of the ink blow-out back surface 18, so that the ink could be smoothly passed and blown out straight. The filler 40 was the positive-type photosensitive resist, "OFPR-800" having a viscosity of 30 centipoises, produced by Tokyo Oka Co., uniformly applied on the whole surface of the nozzle plate 7 by the spin-coating method, and was pre-baked at a temperature of about 90° C. This Example has used the photosensitive resist as a filler. It is, however, also allowable to use a photosensitive resin film, a liquid photosensitive resist material or any other resin material that exhibits resistance against chemicals in the fluorine-contained resin eutectoid plating solution or against the chemicals used for the pre-treatment for applying the fluorine-contained resin eutectoid plating.

Figure 40:
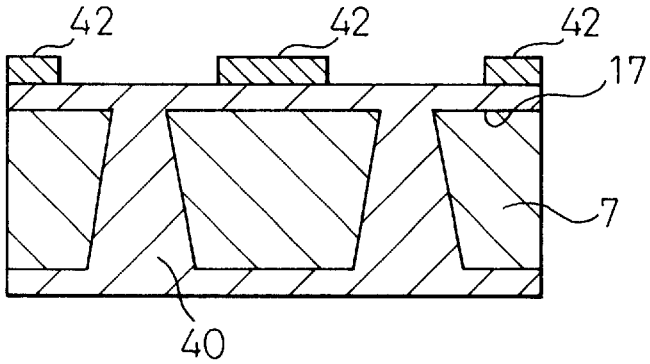

Then, as shown in FIG. 40, a mask 42 that does not transmit ultraviolet rays was placed on the side of the ink blow-out surface 17 of the nozzle plate 7 for forming a pattern. The mask works as a protection film for not forming the fluorine-contained resin eutectoid plated film on the regions other than the desired regions in the subsequent step of plating.

Figure 41:
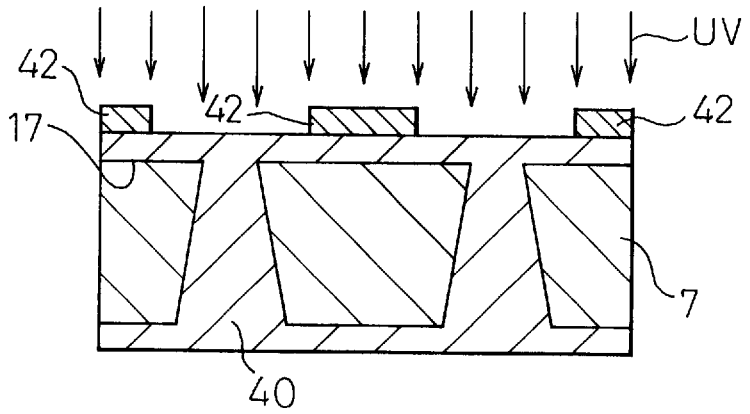
Figure 42:
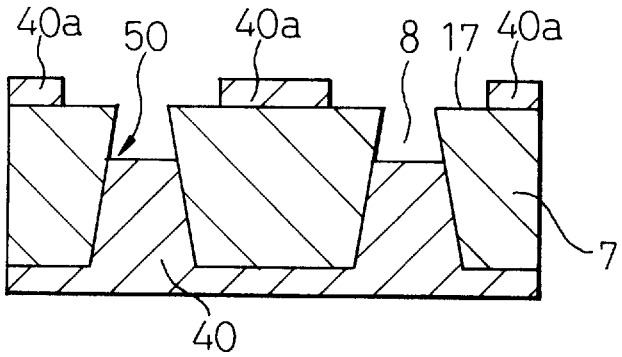

Then, as indicated by arrows in FIG. 41, the ultraviolet rays (UV) having an intensity of 10 mW/cm$^2$ and a wavelength of 436 nm corresponding to the properties of the photosensitive resist that was used, were irradiated for about 10 seconds from the side of the ink blow-out surface 17 of the nozzle plate 7 in the presence of the mask 42. Such an exposure condition was employed for adjusting the intensity of exposure and the exposure time for forming the boundary 50 of the fluorine-contained resin eutectoid plated film 15 shown in FIG. 38 in the ink blow-out holes 8.

As a result of exposure to the whole surface and the subsequent developing for removing the exposed portion by dissolution, a pattern 40*a* of the filler 40 which was not exposed to light due to the mask 42 was formed on the ink blow-out surface 17 of the nozzle plate 7, and the pattern of the filler 40 for forming the boundary 40 remained in the ink blow-out holes 8 without being dissolved due to the adjustment of the ultraviolet rays. Here, the boundary 50 was obtained by developing the photosensitive resist after exposure to light by using a developing solution, NMD-W, produced by Tokyo Oka Co.

Figure 43:
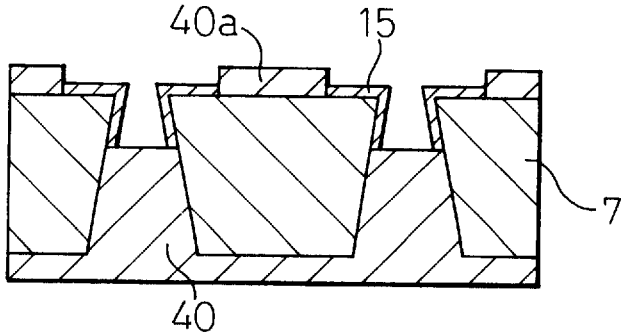

Thereafter, the fluorine-contained resin eutectoid plating was applied to the whole surface of the nozzle plate 7 in the presence of the fillers 40 and 40*a* remaining on the peripheries of the nozzle plate 7. In applying the fluorine-contained resin eutectoid plating, first, the plating surface of the nozzle plate 7 was activated by using an aqueous solution of hydrochloric acid, and nickel chloride was strike-plated at a current density of 6 A/dm$^2$ for 2 minutes. Next, the nozzle plate was washed with pure water to effect the fluorine-contained resin eutectoid plating. The fluorine-contained resin eutectoid plating was applied by using "Metafron FS" (trade name) produced by Uemura Kogyo Co. as a plating solution, stirring the solution while maintaining its temperature at 42° C. and passing a current at a density of 2 A/dm$^2$. As shown in FIG. 43, the fluorine-contained resin eutectoid plated film 15 having a thickness of about 3 μm was formed while being limited to the exposed surface of the nozzle plate 7. Here, the thickness of the fluorine-contained resin eutectoid plated film 15 can be selected to meet the required nozzle diameter. It was, however, learned that the thickness of the film must not be smaller than 2 μm and, preferably, not smaller than 3 μm to obtain excellent durability. when the surface of the nozzle plate 7 has been contaminated prior to effecting the activation treatment, there may also be employed a treatment for removing organic matter, such as treatment based on oxygen plasma or UV ozone. The activation treatment is not limited to the one that uses hydrochloric acid only, but may be the one that uses sulfuric acid, phosphoric acid or hydrofluoric acid, or a mixture thereof.

Thereafter, the fillers 40 and 40*a* were removed by using a peeling solution. The peeling solution used here was the peelant 104 produced by Tokyo Oka Co. exclusively for the positive-type photosensitive resist, OFPR-800, used as the filler. In removing the fillers 40 and 40*a*, a peeling solution is selected to not affect the nozzle plate 7 or the fluorine-contained resin eutectoid plated film 15. Some fillers can be removed by the treatment with heat.

After the filler has been removed, it is desired that the nozzle plate is heat-treated at a temperature higher than the melting point of the fluorine-contained resin used for the plating. In this Example, therefore, the heat-treatment was conducted at a temperature of 350° C. higher than the melting point (about 327° C.) of the fluorine-contained resin PTFE for about 1 hour. Here, the PTFE is thermally decomposed at a temperature near 400° C. It is therefore important to so control the heat-treatment that the temperature does not exceed 400° C. In the heat-treatment of the fluorine-contained resin, since the melting point differs depending upon the fluorine-contained resins, it is necessary to pay attention to controlling the heat-treatment temperature in view of the melting point and not exceed the heat-decomposition temperatures. When the properties differ depending upon the degree of crystallinity after cooling, it is better to give consideration to the cooling temperature and the cooling method. When a representative PTFE is used as the fluorine-contained resin, the degree of crystallinity differs depending upon the cooling rate. When quickly quenched, in general, the degree of crystallinity is low and excellent durability is exhibited. After the heat-treatment, therefore, it is desired that the cooling plate is forcibly cooled by blowing air rather than being left to stand in the air for cooling. It will be even more effective if the nozzle plate is cooled by being immersed in a solvent such as water.

In order to make sure the action and effect of the nozzle plate prepared in this Example, a nozzle plate for reference was prepared in the same manner as described above by forming the fluorine-contained resin eutectoid plated film on the whole ink blow-out surface 17 but without using the mask 42 shown in FIG. 40. Next, the ink-jet heads of the constitution shown in FIG. 1 were assembled by using the nozzle plate of this Example and the reference nozzle plate, and the pigment-type ink was poured therein to repeat the test of blowing out the ink and wiping by using a blade made of an elastic rubbery material. The nozzle plate of this Example and the reference nozzle plate possessed different coefficients of friction and, hence, the load on the blade was set to a minimum value within a range in which the ink droplets adhered to the ink blow-out surfaces could be completely removed. Therefore, the load of the blade was about 100 g/cm$^2$. As a result of the testing, it was learned that with the ink-jet head using the reference nozzle plate, the ink droplets were not often removed after the wiping was repeated 3,000 times or 5,000 times. With the head using the nozzle plate of this Example, the ink droplets could be stably removed even after the wiping was repeated more than 10,000 times. These two kinds of the nozzle plates were observed for their surfaces by using the scanning-type electron microscope (SEM). In the reference nozzle, the fluorine-contained resin was missing in many portions due to wear from the surface of the fluorine-contained resin eutectoid plated film. In the nozzle plate of this Example, almost no fluorine-contained resin was missing from the surface of the fluorine-contained resin eutectoid plated film. It was thus learned that the nozzle plate of this Example exhibited superior results to the reference nozzle plate and the fluorine-contained eutectoid plated film were hardly worn no matter how the ink viscosity and surface tension were adjusted by using the dye-type ink under various conditions.

Example 10

The procedure described in Example 9 was repeated and, here, the shape of the nozzle plate was changed to change the shape of the mask 42 shown in FIG. 40, in order to prepare a nozzle plate 92 having a step shown in FIGS. 49 and 50. This nozzle plate, too, was a nickel plate obtained by an electroforming method as in the case of the above-mentioned Example 9. The ink blow-out holes 8 were tapered in cross section and possessed a diameter of 35 μm on the side of the ink blow-out surface 17 and a diameter of 50 μm on the side of the ink blow-out back surface 18, so that the ink could be smoothly passed and blown out straight. The nozzle plates 70 and 71 possessed a step 72 near the ink blow-out holes 8, the step 71 being lower by 5 μm than the outer peripheries of the ink blow-out holes 8, and the position of the step 71 being separated by about 150 μm from the centers of the ink blow-out holes 8.

The testing of blowing out the ink and wiping by using the blade made of an elastic rubbery material was repeated in a manner as described in Example 9. It was confirmed that the nozzle plate 72 of this Example possessed durability against the wiping equal to, or greater than, that of the nozzle plate 7 of the above Example.

Example 11

The procedures described in Examples 9 and 10 were repeated and, here, the shape of the nozzle plate and the shape of the nozzle holes were changed, and the shape of the mask 42 shown in FIG. 40 was adjusted correspondingly, to produce the nozzle plates 7 having the fluorine-contained resin eutectoid plated film of patterns shown in FIGS. 44 to 48 as viewed from the side of the ink blow-out surface 17.

Removal of the ink by wiping using a blade made of an elastic rubbery material was examined in a manner as described in Example 9. The nozzle plate 7 (fluorine-contained resin eutectoid plated film of a pattern 51) shown in FIG. 44 enabled the ink to be stably removed in any wiping direction. The nozzle plate 7 (fluorine-contained resin eutectoid plated film of a pattern 53) shown in FIG. 45 enabled the ink to be very easily removed when it was wiped in a direction 52, and exhibited very good durability. The nozzle plate 7 (fluorine-contained resin eutectoid plated film of a pattern 54) shown in FIG. 46 enabled the ink to be very easily removed when it was wiped in a direction 55, the nozzle plate 7 (fluorine-contained resin eutectoid plated film of a pattern 58) shown in FIG. 47 enabled the ink to be very easily removed when it was wiped in a direction 57, and the nozzle plate 7 (fluorine-contained resin eutectoid plated film of a pattern 60) shown in FIG. 48 enabled the ink to be very easily removed when it was wiped in a direction 59. It was thus confirmed that by using fluorine-contained resin eutectoid plated films including a plurality of ink blow-out holes of patterns shown in FIGS. 45 to 48, the effect for removing the ink could be enhanced and the durability could be improved by adjusting the direction for moving the blade at the time of wiping.

Industrial Applicability

According to the present invention, as will be understood from the foregoing detailed description, there are obtained many functions and effects that are worth notice as will be described below, making the invention well suited for being advantageously used in the field of recording by ink jet.

First, on the ink blow-out surface of the nozzle plate, the density of the fluorine-contained resin is controlled on the surface of the fluorine-contained resin-containing composite plating to suit the ink that is used. After the ink is blown out, therefore, the ink does not stay adhered around the ink blow-out nozzles and the ink droplets are stably blown out straight, enabling the ink-jet printer to exhibit improved reliability in printing quality.

Second, the fluorine-contained resin-containing composite plating is applied as an ink-repelling layer maintaining a thickness of not smaller than 2.0 μm and, preferably, not smaller than 3.0 μm around the nozzles and on the surface of the nozzle plate, and is fired at a temperature higher than the melting point of the fluorine-contained resin, making it possible to obtain a nozzle plate which exhibits excellent resistance against the positive pressure, does not permit the ink to stay adhered around the nozzles after the ink is blown out, permits the ink droplets to be stably blown out straight, contributing to improving reliability of the ink-jet head not only in the early time but also for extended periods of time.

Third, in the step of applying the fluorine-contained resin-containing nickel composite plating which is the liquid-repelling film on the ink blow-out surface and in the ink blow-out nozzles of the nozzle plate, ultrasonic waves are applied to the plating solution after the nozzle plate is immersed in the plating solution, so that the fluorine-contained resin-containing nickel composite plating solution easily enters into the nozzles and that the boundary position between the water-repelling region and the hydrophilic region is constantly determined in the nozzles. Accordingly, the meniscus position is set constant, the ink is permitted to be stably blown out, and the reliability of the ink-jet printer is further improved.

Fourth, according to the present invention, there is obtained a nozzle plate for the ink-jet head having a boundary position between the water-repelling region and the hydrophilic region constantly defined in the ink blow-out nozzles, and having an ink blow-out surface coated with the fluorine-contained resin-containing nickel composite plating which is free of defect. This strikingly improves the long term reliability of the ink-jet printer.

Fifth, according to the present invention, there is obtained a nozzle plate for the ink-jet head in which the fluorine-contained resin-containing composite plating formed on the surface of the nozzle plate is finely finished on its surface, whereby the fluorine-contained resin-containing composite plated film exhibits improved durability and excellent reliability for extended periods of time. As a result, it is made possible to produce an ink-jet head which permits the ink to be selected from a strikingly widened range, and features excellent printing quality.

Sixth, according to the present invention, there is obtained a nozzle plate for the ink-jet head which suppresses reduction in the water-repelling property on the ink blow-out surface, maintains water-repelling property at all times, and stably blows out the ink. This contributes to strikingly improving the reliability of the ink-jet printer for extended periods of time.

Seventh, according to the present invention, a portion where the fluorine-contained resin-containing composite plated film is formed and a portion where no such film is formed, are included in the ink blow-out surface of the flat member that has ink blow-out nozzles penetrating therethrough, the nozzles on the side of the ink blow-out surface being included in the portion where the fluorine-contained resin-containing composite plated film is formed, and the fluorine-contained resin-containing composite plated film continuing from the peripheries of the nozzles to the interiors of the nozzles. Therefore, the ink droplets adhered near the nozzles are easily moved to the portion where the fluorine-contained resin-containing composite plated film is not formed and is efficiently removed by the blade during the wiping operation. Accordingly, the fluorine-contained resin-containing composite plated film is hardly worn out by the blade during the wiping operation, and long term reliability for maintenance is improved compared to the prior art.

According to the present invention, furthermore, the ink blow-out nozzles and the peripheries of the nozzles are stepped to be lower than the surroundings of the nozzles in the ink blow-out surface of the flat plate member, and the fluorine-contained resin-containing composite plated film including the nozzles is formed to include the wall of the step. Therefore, this step works to further reduce the friction between the plated film near the nozzles and the blade during the wiping operation. This decreases the abrasion of the plated film caused by the blade during the wiping operation and further improves the long-lasting reliability for the maintenance.

According to this embodiment, furthermore, the flat plate member has a plurality of ink blow-out nozzles, and the portion where the fluorine-contained resin-containing composite plated film is formed has a pattern to include one or a plurality of ink blow-out nozzles, the pattern being formed in a number of one or in a plural number.

In addition to the above-mentioned actions and effects, therefore, the pattern and the wiping direction of the ink blow-out nozzles are adjusted to more effectively remove the ink.

Since the fluorine-contained resin-containing composite plated film is worn out little by wiping, the nozzle plate for the ink-jet head of the present invention exhibits greatly improved long-lasting reliability for the maintenance. It is therefore made possible to produce an ink-jet head which permits the ink to be selected from a strikingly widened range, and features excellent printing quality.

Though the specification has described the fluorine-contained resin-containing nickel composite plating that is applied to only the nozzle plate for the ink-jet head, it should be noted that the composite plated film can be effectively applied to those having similar constitutions such as interiors of the through holes and the surfaces having fine roughness in addition to the nozzle plate.

What is claimed is:

1. A nozzle plate for an ink-jet head used in an ink-jet recorder, said nozzle plate comprising a flat plate member which defines an ink blow-out surface on one main surface thereof and has a plurality of ink blow-out nozzles penetrating the plate member at predetermined positions; wherein said ink blow-out surface and portions of inner surfaces of said ink blow-out nozzles adjacent said ink blow-out surface, have, at least partly, an ink-repelling layer consisting of a composite of a matrix metal and a fluorine-containing resin formed directly thereon by electrolytic or non-electrolytic composite plating, said ink-repelling layer having a varying distribution in the content of said fluorine-containing resin in the direction of thickness of the layer, and containing the fluorine-containing resin in larger amounts on an outer surface region of the layer.

2. A nozzle plate for an ink-jet head according to claim 1, wherein said ink-repelling layer is finely finished on its outer surface in at least the region of said ink blow-out surface.

3. A nozzle plate for an ink-jet head according to claim 2, wherein said ink-repelling layer has a center average surface roughness Ra of from 0.02 to 0.1 $\mu$m.

4. A nozzle plate for an ink-jet head according to claim 1, wherein said ink-repelling layer has a rough surface in the region of said ink blow-out surface.

5. A nozzle plate for an ink-jet head according to claim 4, where a height of roughness in a surface of said ink-repelling layer is not smaller than 0.01 $\mu$m but is not larger than a thickness of said ink-repelling layer.

6. A nozzle plate for an ink-jet head according to claim 1, wherein said ink-repelling layer is formed on ends of the inner surfaces of said ink blow-out nozzles adjacent said ink blow-out surface and on peripheries surrounding said ink blow-out nozzles on said ink blow-out surface.

7. A nozzle plate for an ink-jet head according to claim 6, wherein said ink-repelling layer has a step in the peripheries surrounding said ink blow-out nozzles, the step being larger than a thickness of said ink-repelling layer.

8. A nozzle plate for an ink-jet head according to claim 1, wherein said ink-repelling layer has a thickness of at least 2.0 $\mu$m.

9. A nozzle plate for an ink-jet head according to claim 1, wherein said ink-repelling layer is continuous from said ink blow-out surface to the inner surfaces of said ink blow-out nozzles.

10. An ink-jet head used in an ink-jet recorder, comprising an ink chamber, a nozzle plate having a flat plate member which defines an ink blow-out surface on one main surface thereof and has a plurality of ink blow-out nozzles penetrating the plate member at predetermined positions that communicate with said ink chamber, and a pressure generator capable of moving ink droplets out of the nozzles of the nozzle plate toward a recording medium by applying a pressure to ink in the ink chamber; wherein the ink blow-out surface and portions of inner surfaces of the ink blow-out nozzles adjacent the ink blow-out surface, have, at least partly, an ink-repelling layer consisting of a composite of a matrix metal and a fluorine-containing resin formed directly thereon by electrolytic or non-electrolytic composite plating, said ink-repelling layer having a varying distribution in the content of said fluorine-containing resin in the direction of thickness of the layer, and containing the fluorine-containing resin in larger amounts on an outer surface region of the layer.

11. An ink-jet head according to claim 10, wherein said ink-repelling layer is finely finished on its outer surface in at least the region of said ink blow-out surface.

12. An ink-jet head according to claim 11, wherein said ink-repelling layer has a center average surface roughness Ra of from 0.02 to 0.1 $\mu$m.

13. An ink-jet head according to claim 10, wherein said ink-repelling layer has a rough surface in the region of said ink blow-out surface.

14. An ink-jet head according to claim 13, wherein a height of roughness in a surface of said ink-repelling layer is not smaller than 0.01 $\mu$m but is not larger than a thickness of said ink-repelling layer.

15. An ink-jet head according to claim 10, wherein said ink-repelling layer is formed on ends of the inner surfaces of said ink blow-out nozzles adjacent said ink blow-out surface and on peripheries surrounding said ink blow-out nozzles on said ink blow-out surface.

16. An ink-jet head according to claim 15, wherein said ink-repelling layer has a step in the peripheries surrounding said ink blow-out nozzles, the step being larger than a thickness of said ink-repelling layer.

17. An ink-jet head according to claim 10, wherein said ink-repelling layer has a thickness of at least 2.0 $\mu$m.

18. An ink-jet head according to claim 10, wherein said ink-repelling layer is continuous from said ink blow-out surface to the inner surfaces of said ink blow-out nozzles.

* * * * *